US008882940B2

(12) United States Patent
Johnson et al.

(10) Patent No.: US 8,882,940 B2
(45) Date of Patent: Nov. 11, 2014

(54) BULK SOLIDIFYING AMORPHOUS ALLOYS WITH IMPROVED MECHANICAL PROPERTIES

(75) Inventors: William Johnson, Pasadena, CA (US); Jan Schroers, Laguna Beach, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 0 days.

(21) Appl. No.: 13/364,128

(22) Filed: Feb. 1, 2012

(65) Prior Publication Data

US 2012/0298266 A1 Nov. 29, 2012

Related U.S. Application Data

(63) Continuation of application No. 13/032,375, filed on Feb. 22, 2011, which is a continuation of application No. 11/303,844, filed on Dec. 16, 2005, now Pat. No. 7,896,982, which is a continuation-in-part of application No. 10/540,337, filed as application No. PCT/US03/41345 on Dec. 22, 2003, now Pat. No. 7,582,172.

(60) Provisional application No. 60/435,408, filed on Dec. 20, 2002, provisional application No. 60/637,251, filed on Dec. 17, 2004, provisional application No. 60/637,330, filed on Dec. 17, 2004.

(51) Int. Cl.
*C22C 45/00* (2006.01)
*C22B 9/04* (2006.01)

(52) U.S. Cl.
CPC .. *C22C 45/00* (2013.01); *C22B 9/04* (2013.01)
USPC ..... 148/538; 148/561; 164/61; 164/474

(58) Field of Classification Search
None
See application file for complete search history.

(56) References Cited

U.S. PATENT DOCUMENTS

| | | | |
|---|---|---|---|
| 2,106,145 | A | 1/1938 | Floraday |
| 2,124,538 | A | 7/1938 | Boyer |
| 3,322,546 | A | 5/1967 | Tanzman et al. |
| 3,539,192 | A | 11/1970 | Prasse |
| 3,558,846 | A | 1/1971 | Ujiie |
| 3,696,228 | A | 10/1972 | Thomas, Jr. et al. |
| 3,742,585 | A | 7/1973 | Wentzell |
| 3,776,297 | A | 12/1973 | Williford et al. |
| 3,948,613 | A | 4/1976 | Weill |
| 3,970,445 | A | 7/1976 | Gale et al. |
| 3,986,867 | A | 10/1976 | Masumoto et al. |
| 3,986,892 | A | 10/1976 | Ewe et al. |
| 4,024,902 | A | 5/1977 | Baum |
| 4,067,732 | A | 1/1978 | Ray |
| 4,124,472 | A | 11/1978 | Riegert |
| 4,125,737 | A | 11/1978 | Andersson |
| 4,163,071 | A | 7/1979 | Weatherly et al. |
| 4,260,416 | A | 4/1981 | Kavesh et al. |
| 4,268,564 | A | 5/1981 | Narasimhan |
| 4,309,587 | A | 1/1982 | Nakano et al. |
| 4,321,289 | A | 3/1982 | Bartsch |
| 4,330,027 | A | 5/1982 | Narasimhan |
| 4,373,128 | A | 2/1983 | Asai et al. |
| 4,374,900 | A | 2/1983 | Hara et al. |
| 4,381,943 | A | 5/1983 | Dickson et al. |
| 4,396,820 | A | 8/1983 | Puschner |
| 4,409,296 | A | 10/1983 | Ward |
| 4,482,612 | A | 11/1984 | Kuroki et al. |
| 4,487,630 | A | 12/1984 | Crook et al. |
| 4,488,882 | A | 12/1984 | Dausinger et al. |
| 4,499,158 | A | 2/1985 | Onuma et al. |
| 4,515,870 | A | 5/1985 | Bose et al. |
| 4,523,625 | A | 6/1985 | Ast |
| 4,526,618 | A | 7/1985 | Keshavan et al. |
| 4,557,981 | A | 12/1985 | Bergmann |
| 4,564,396 | A | 1/1986 | Johnson et al. |
| 4,570,568 | A | 2/1986 | Fair |
| 4,585,617 | A | 4/1986 | Tenhover et al. |
| 4,612,059 | A | 9/1986 | Mori et al. |
| 4,656,099 | A | 4/1987 | Sievers |
| 4,668,310 | A | 5/1987 | Kudo et al. |
| 4,707,581 | A | 11/1987 | Blaskovits et al. |
| 4,725,512 | A | 2/1988 | Scruggs |
| 4,731,253 | A | 3/1988 | DuBois |
| 4,741,974 | A | 5/1988 | Longo et al. |

(Continued)

FOREIGN PATENT DOCUMENTS

| | | | |
|---|---|---|---|
| DE | 010237992 | A1 | 3/2003 |
| EP | 0164200 | A1 | 12/1985 |

(Continued)

OTHER PUBLICATIONS

Author unknown, "Standard Practice for Conducting Dry Sand/Rubber Wheel Abrasion Tests", ASTM Designation: G 65-81, pp. 351-368, revised 1981.

Koch et al., "Preparation of "Amorphous" $Ni_{60}Nb_{40}$ by Mechanical Alloying", Appl. Phys. Lett., Dec. 1, 1983, vol. 43, No. 11, pp. 1017-1019.

Author unknown, "A World of Superabrasives Experience At Your Service", source unknown, 4 Pgs.

Author unknown, "GE Superabrasives—The Metal Bond System", source unknown, 1 pg.

(Continued)

*Primary Examiner* — George Wyszomierski
(74) *Attorney, Agent, or Firm* — Pillsbury Winthrop Shaw Pittman LLP

(57) ABSTRACT

Bulk solidifying amorphous alloys exhibiting improved processing and mechanical properties and methods of forming these alloys are provided. The bulk solidifying amorphous alloys are composed to have high Poisson's ratio values. Exemplary Pt-based bulk solidifying amorphous alloys having such high Poisson's ratio values are also described. The Pt-based alloys are based on Pt—Ni—Co—Cu—P alloys, and the mechanical properties of one exemplary alloy having a composition of substantially $Pt_{57.5}Cu_{14.7}Ni_{5.3}P_{22.5}$ are also described.

22 Claims, 9 Drawing Sheets

(56) References Cited

U.S. PATENT DOCUMENTS

| | | | | |
|---|---|---|---|---|
| 4,770,701 | A | 9/1988 | Henderson et al. | |
| 4,810,850 | A | 3/1989 | Tenkula et al. | |
| 4,850,524 | A | 7/1989 | Schick | |
| 4,960,643 | A | 10/1990 | Lemelson | |
| 5,030,519 | A | 7/1991 | Scruggs et al. | |
| 5,127,969 | A | 7/1992 | Sekhar | |
| 5,189,252 | A | 2/1993 | Huffman et al. | |
| 5,288,344 | A | 2/1994 | Peker et al. | |
| 5,294,462 | A | 3/1994 | Kaiser et al. | |
| 5,324,368 | A * | 6/1994 | Masumoto et al. | 148/561 |
| 5,368,659 | A | 11/1994 | Peker et al. | |
| 5,380,349 | A | 1/1995 | Taniguchi et al. | |
| 5,440,995 | A | 8/1995 | Levitt | |
| 5,482,577 | A | 1/1996 | Hashimoto et al. | |
| 5,567,251 | A | 10/1996 | Peker et al. | |
| 5,567,532 | A | 10/1996 | Peker et al. | |
| 5,735,975 | A | 4/1998 | Lin et al. | |
| 6,010,580 | A | 1/2000 | Dandliker et al. | |
| 6,183,889 | B1 | 2/2001 | Koshiba et al. | |
| 6,218,029 | B1 | 4/2001 | Rickerby | |
| 6,325,868 | B1 | 12/2001 | Kim et al. | |
| 6,326,295 | B1 | 12/2001 | Figura | |
| 6,427,753 | B1 * | 8/2002 | Inoue et al. | 164/80 |
| 6,620,264 | B2 | 9/2003 | Kundig et al. | |
| 6,623,566 | B1 * | 9/2003 | Senkov et al. | 148/121 |
| 6,749,698 | B2 | 6/2004 | Shimizu et al. | |
| 7,410,546 | B2 * | 8/2008 | Tews | 148/430 |
| 7,582,172 | B2 * | 9/2009 | Schroers et al. | 148/403 |
| 2002/0036034 | A1 | 3/2002 | Xing et al. | |

FOREIGN PATENT DOCUMENTS

| | | | |
|---|---|---|---|
| GB | 2005302 | A | 4/1979 |
| GB | 2106145 | A | 2/1987 |
| JP | 56-112449 | | 9/1981 |
| JP | 2002-053918 | | 2/2002 |
| JP | 2002-069549 | | 3/2002 |
| JP | 2002-275605 | A | 9/2002 |
| WO | WO00/68469 | A2 | 11/2000 |
| WO | WO03/040422 | A1 | 5/2003 |
| WO | WO-2004/059019 | A1 | 7/2004 |
| WO | WO 2004/059019 | A1 | 7/2004 |

OTHER PUBLICATIONS

Author unknown, "GE Superabrasives—The Resin Bond System", source unknown, 1 pg.

Author unknown, "GE Superabrasives—Micron Powders", source unknown, 1 pg.

Author unknown, "GE Superabrasives—The MBS 700 Series Product Line", source unknown, 2 pgs., Oct. 1992.

International Search Report for International Application No. PCT/US2005/045955 filed Dec. 16, 2005, completed Jun. 29, 2006, mailed Aug. 18, 2006, 3 pgs.

Written Opinion for International Application No. PCT/US2005/045955 filed Dec. 16, 2005, completed Jun. 29, 2006, mailed Aug. 18, 2006, 5 pgs.

Author unknown, "GE Superabrasives—The MBS-900 Series Product Line", source unknown, 2 pgs., 1992.

Masumoto, "Recent Progress in Amorphous Metallic Materials in Japan", Materials Science and Engineering, 1994, vol. A179/A180, pp. 8-16.

ASM Committee on Tooling Materials, "Superhard Tool Materials", Metals Handbook, Ninth Edition, vol. 3, Properties and Selection: Stainless Steels, Tool Materials and Special Purpose Metals, American Society for Metals, 1980, pp. 448-465, title page and copyright page.

* cited by examiner

BULK SOLIDIFYING AMORPHOUS ALLOYS WITH IMPROVED MECHANICAL PROPERTIES

CROSS REFERENCE TO RELATED APPLICATIONS

This is a continuation of U.S. application Ser. No. 13/032,375 filed Feb. 22, 2011, which is a continuation of U.S. application Ser. No. 11/303,844 filed Dec. 16, 2005 now U.S. Pat. No. 7,896,982 which is a continuation-in-part of U.S. application Ser. No. 10/540,337 filed Jun. 20, 2005 now U.S. Pat. No. 7,582,172, which in turn claims priority to U.S. Provisional Application No. 60/637,251 filed Dec. 17, 2004, and U.S. Provisional Application No. 60/637,330 filed Dec. 17, 2004, each of which are incorporated by reference herein in their entireties. U.S. application Ser. No. 10/540,337 filed Jun. 20, 2005 is also a national stage entry of International Application No. PCT/US2003/041345 filed Dec. 22, 2003, which in turn claims priority to U.S. Provisional Application No. 60/435,408 filed Dec. 20, 2002, each of which are incorporated by reference herein in their entireties.

FIELD OF THE INVENTION

The present invention is directed to bulk solidifying amorphous alloys exhibiting improved processing and mechanical properties, particularly bulk solidifying amorphous alloys having high values of Poisson's ratio, and more particularly to Pt-based bulk solidifying amorphous alloys having high values of Poisson's ratio.

BACKGROUND OF THE INVENTION

Amorphous alloys have generally been prepared by rapid quenching from above the melt temperatures to ambient temperatures. Generally, cooling rates of $10^{5}$° C./sec have been employed to achieve an amorphous structure. However, at such high cooling rates, the heat can not be extracted from thick sections, and, as such, the thickness of articles made from amorphous alloys has been limited to tens of micrometers in at least in one dimension. This limiting dimension is generally referred to as the critical casting thickness, and can be related by heat-flow calculations to the cooling rate (or critical cooling rate) required to form an amorphous phase.

This critical thickness (or critical cooling rate) can also be used as a measure of the processability of an amorphous alloy. Until the early nineties, the processability of amorphous alloys was quite limited, and amorphous alloys were readily available only in powder form or in very thin foils or strips with critical dimensions of less than 100 micrometers. However, in the early nineties, a new class of amorphous alloys was developed that was based mostly on Zr and Ti alloy systems. It was observed that these families of alloys have much lower critical cooling rates of less than $10^{3}$° C./sec, and in some cases as low as 10° C./sec. Accordingly, it was possible to form articles having much larger critical casting thicknesses of from about 1.0 mm to as large as about 20 mm. As such, these alloys are readily cast and shaped into three-dimensional objects, and are generally referred to as bulk-solidifying amorphous alloys ("B-SA Alloys"). Recently, several new classes of B-SA Alloy have been discovered which include Pt-base, Fe-base etc.

The unique properties of B-SA Alloys includes very high strength, high specific strength, large elastic strain limit, and high corrosion resistance that make them interesting for structural applications. However, B-SA Alloys show relatively limited ductility and low toughness compared to their high yield strength values. For example, when a strip of B-SA Alloy having a 2.0 mm thickness is subjected to loading at room temperature, very little (less than 2% if any) plastic deformation takes place upon yielding before failure. Upon yielding, B-SA Alloys tend to form shear bands in which plastic deformation occurs in a highly localized manner. In an unconfined geometry, failure of the B-SA Alloys typically occurs along a single shear band that cuts across the sample at an angle of 45° (the direction of maximum resolved shear stress) with respect to the compression axis. This limits the global plasticity of B-SA Alloys in unconfined geometries to less than 1%, and restricts the use of B-SA Alloys as structural materials for most applications. Furthermore, B-SA Alloys show relatively lower resistance to crack propagation, which precludes the effective use of their high yield strength values.

Additional challenges are encountered in using B-SA Alloys for precious metal applications. For example, although the overall properties of B-SA Alloys makes Pt-base B-SA Alloys attractive for jewelry applications, jewelry accessories made from amorphous platinum alloy have to withstand temperatures up to 200° C. In order to use the alloy for jewelry accessories it has to maintain its amorphous nature up to 200° C. This means that the glass transition temperature should be above 200° C. On the other hand, the glass transition temperature should be low in order to both lower the processing temperature and minimize shrinkage due to thermal expansion. In addition, Pt-rich bulk amorphous alloys have compositions close to the eutectic compositions. Therefore, the liquidus temperature of the alloy is generally lower than the average liquidus temperature of the constituents. Bulk solidifying amorphous alloys with a liquidus temperature below 1000° C. or more preferably below 700° C. would be desirable due to the ease of fabrication. Reaction with the mold material, oxidation, and embrittlement would be highly reduced compare to the commercial crystalline Pt-alloys.

Trying to achieve these properties is a challenge in casting commercially used platinum alloys due to their high melting temperatures. For example, conventional Pt-alloys have melting temperatures generally above 1700° C. These high melting temperature causes serious problems in processing. At processing temperatures above the melting temperature the Pt alloy react with most investment materials which leads to contamination, oxidation, and embrittlement of the alloy. To process alloys at these elevated temperatures sophisticated expensive equipment is mandatory. In addition, during cooling to room temperature these materials shrink due to crystallization and thermal expansion. This leads to low quality casting results. In order to increase the properties subsequent processing steps such as annealing are necessary. Another challenge in processing commercial crystalline Pt-alloys is that during crystallization the alloy changes its composition. This results in a non-uniform composition in at least at portion of the alloy.

Accordingly, a need exists to develop highly processable bulk solidifying amorphous alloys with high ductility, such as platinum rich compositions for jewelry applications. Although a number of different bulk-solidifying amorphous alloy formulations have been previously disclosed, none of these formulations have been reported to have the desired processability and improved mechanical properties, such as those desired in jewelry applications.

SUMMARY OF THE INVENTION

The present invention is directed to bulk-solidifying amorphous alloys exhibiting improved processability and mechanical properties.

In one embodiment of the invention, the bulk-solidifying amorphous alloy has a Poisson's ratio of 0.38 or higher.

In one preferred embodiment, the bulk-solidifying amorphous alloy has a Poisson's ratio of 0.42 or higher.

In one preferred embodiment, the bulk-solidifying amorphous alloy has a Poisson's ratio of 0.42 or higher and an elastic strain limit in the range of 1.5% to 2.0%.

In one embodiment of the invention, the bulk-solidifying amorphous alloy has a Poisson's ratio greater than 0.38 and as such exhibiting a ductility of more than 10% under compression geometries with aspect ratio more than 2.

In one embodiment of the invention, the bulk-solidifying amorphous alloy has a Poisson's ratio greater than 0.42 and as such exhibiting a ductility of more than 20% under compression geometries with aspect ratio more than 2.

In one embodiment of the invention, the hulk-solidifying amorphous alloy has a Poisson's ratio greater than 0.38 and as such exhibiting a bend ductility of more than 3% under bending geometries with thickness more than 2.0 mm.

In another preferred embodiment of the invention, the bulk-solidifying amorphous alloy has a Poisson's ratio greater than 0.42 and as such exhibiting a bend ductility of more than 3% under bending geometries with thickness more than 4.0 mm.

In another preferred embodiment of the invention, the bulk-solidifying amorphous alloy has a Poisson's ratio greater than 0.42 and as such exhibiting a bend ductility of more than 10% under bending geometries with thickness of more than 2.0 mm.

In still another embodiment, the invention is directed to bulk-solidifying amorphous alloys with a Poisson's ratio of 0.38 of larger after being reheating in the supercooled liquid region where the processing parameters are chosen such that the crystalline volume fraction of the alloys to be less than 5% by volume.

In still another embodiment, the invention is directed to bulk-solidifying amorphous alloys that after reheating in the supercooled liquid region where the processing parameters are chosen such that the crystalline volume fraction of the alloys to be less than 5% by volume. The Poisson's ratio of the material in the as-cast state and the reheated material does not differ by more than 5%.

In still another embodiment, the bulk-solidifying alloy has a Poisson's ratio of 0.38 or higher after being reheated in the supercooled liquid region and formed under a forming pressure in various geometries where the processing parameters are chosen such that the crystalline volume fraction of the alloys to be less than 5% by volume.

In still another embodiment the bulk-solidifying alloy is cooled with rates substantially faster than their critical cooling rate and the fast cooling results in an amorphous material with a Poisson's ratio of 0.38

In still another embodiment the bulk solidifying amorphous alloy has a Poisson's ratio of 0.38 or higher and is implemented in a composite consist of at least 10% of the bulk solidifying amorphous alloy.

In still another embodiment the bulk solidifying amorphous alloy has a Poisson's ratio of 0.38 or higher and show a fracture toughness greater than K1c>35 MPa $m^{-1/2}$.

In still another embodiment the bulk solidifying amorphous alloy has a Poisson's ratio of 0.42 or higher and show a fracture toughness of K1c>60 MPa $m^{-1/2}$.

The present invention is also generally directed to four or five component Pt-based bulk-solidifying amorphous alloys.

In one exemplary embodiment, the Pt-based alloys consist of at least 75% by weight of platinum and is based on Pt—Co—Ni—Cu—P alloys.

In another exemplary embodiment, the Pt-based alloys are Ni-free and consist of at least 75% by weight of platinum and are based on quarternary Pt—Co—Cu—P alloys.

In still another exemplary embodiment, the Pt-based alloys consist of at least 85% by weight of platinum and is based on Pt—Co—Ni—Cu—P alloys.

In yet another exemplary embodiment, the Pt-based alloys are Ni-free and consist of at least 85% by weight of platinum and is based on quarternary Pt—Co—Cu—P alloys.

In still yet another exemplary embodiment, the bulk-solidifying amorphous alloy composition is $Pt_{57.5}Cu_{14.7}Ni_{5.3}P_{22.5}$ (at. %)

In another exemplary embodiment, the bulk-solidifying amorphous alloy $Pt_{57.5}Cu_{14.7}Ni_{5.3}P_{22.5}$ shows a very high fracture toughness of more than 60 MPa $m^{-1/2}$.

In another exemplary embodiment, the bulk-solidifying amorphous alloy $Pt_{57.5}Cu_{14.7}Ni_{5.3}P_{22.5}$ is reheated in the supercooled liquid region for any time and temperature as long as noticeable crystallization (less than 3% by volume) is avoided and the fracture toughness after this process is more than 60 MPa $m^{-1/2}$.

In another exemplary embodiment, two or more pieces of the bulk-solidifying amorphous alloy $Pt_{57.5}Cu_{14.7}Ni_{5.3}P_{22.5}$ can be bond together in an environment consist of air by heating the pieces into the supercooled liquid region and applying a pressure that results in physical contact of the hole surfaces that should bond together.

In another exemplary embodiment, the bulk-solidifying amorphous alloy $Pt_{57.5}Cu_{14.7}Ni_{5.3}P_{22.5}$ can be permanently plastically deformed at room temperature for sample sizes up to 4 mm×4 mm in a bend test.

In another exemplary embodiment, the bulk-solidifying amorphous alloy $Pt_{57.5}Cu_{14.7}Ni_{5.3}P_{22.5}$ exhibit a plastic region of up to 20% under compressive loading with aspect ratios of greater than 2.

In still another embodiment the bulk solidifying amorphous alloy $Pt_{57.5}Cu_{14.7}Ni_{5.3}P_{22.5}$ show a fracture toughness of K1c>70 MPa $m^{-1/2}$.

In still another embodiment the bulk solidifying amorphous alloy $Pt_{57.5}Cu_{14.7}Ni_{5.3}P_{22.5}$ can be plastically deformed by more than 15% in an unconfined geometry under quasistatic compressive loading conditions.

In still another embodiment the bulk solidifying amorphous alloy $Pt_{57.5}Cu_{14.7}Ni_{5.3}P_{22.5}$ can be plastically deformed under bending conditions by more than 2% for sample thicknesses up to 4 mm.

In still another embodiment the bulk solidifying amorphous alloy $Pt_{57.5}Cu_{14.7}Ni_{5.3}P_{22.5}$ has a critical crack radius of 4 mm.

In one embodiment of the invention, the Pt-base bulk-solidifying amorphous alloy exhibits a ductility of more than 10% under compression geometries with aspect ratio more than 2.

In one embodiment of the invention, Pt-base bulk-solidifying amorphous alloy exhibits a ductility of more than 20% under compression geometries with aspect ratio more than 2.

In one embodiment of the invention, Pt-base the bulk-solidifying amorphous exhibits a bend ductility of more than 3% under bending geometries with thickness more than 2.0 mm.

In another preferred embodiment of the invention, Pt-base the bulk-solidifying amorphous alloy exhibits a bend ductility of more than 3% under bending geometries with thickness more than 4.0 mm.

In another preferred embodiment of the invention, Pt-base amorphous alloy exhibits a bend ductility of more than 10% under bending geometries with thickness of more than 2.0 mm.

In still yet another embodiment, the invention is directed to methods of casting these alloys at low temperatures into three-dimensional bulk objects and with substantially amorphous atomic structure. In such an embodiment, the term three dimensional refers to an object having dimensions of least 0.5 mm in each dimension, and preferably 1.0 mm in each dimension. The term "substantially" as used herein in reference to the amorphous metal alloy means that the metal alloys are at least fifty percent amorphous by volume. Preferably the metal alloy is at least ninety-five percent amorphous and most preferably about one hundred percent amorphous by volume.

In still yet another embodiment, the invention is directed to methods of forming the alloy at a temperature between the glass transition temperature and the crystallization temperature in near net shape forms.

In still yet another embodiment the alloy is exposed to an additional processing step to reduce inclusions.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
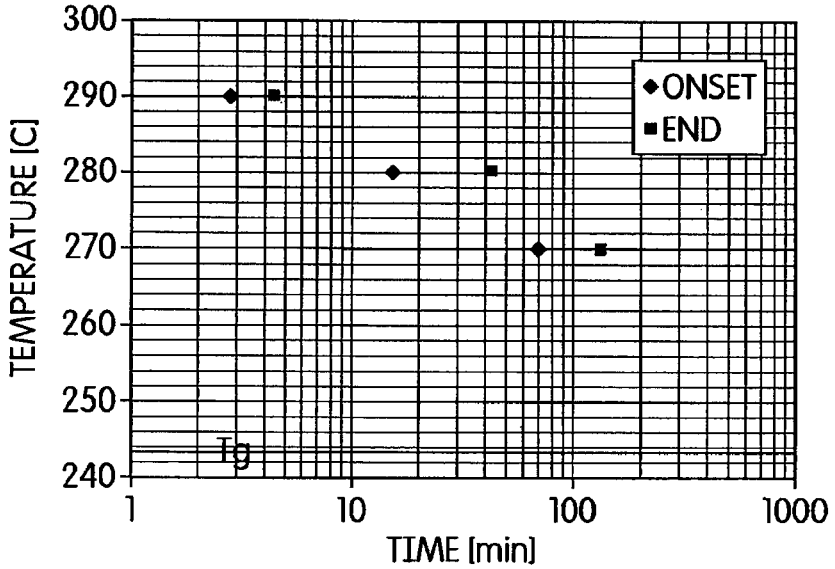
FIG. 1 shows a time temperature transformation diagram for an exemplary Pt-based amorphous alloy ($Pt_{44}Cu_{26}Ni_9P_{21}$)

The present invention is directed to bulk solidifying amorphous alloys ("B-SA Alloys") exhibiting improved processing and mechanical properties, particularly bulk solidifying amorphous alloys having high values of Poisson's ratio, and more particularly to Pt-based bulk solidifying amorphous alloys having high values of Poisson's ratio. For the purposes of this invention, the term amorphous means at least 50% by volume of the alloy has an amorphous atomic structure, and preferably at least 90% by volume of the alloy has an amorphous atomic structure, and most preferably at least 99% by volume of the alloy has an amorphous atomic structure.

In general, crystalline precipitates in amorphous alloys are highly detrimental to their properties, especially to the toughness and strength, and as such it is generally preferred to limit these precipitates to as small a minimum volume fraction possible so that the alloy is substantially amorphous. However, there are cases in which, ductile crystalline phases precipitate in-situ during the processing of bulk solidifying amorphous alloys, which are indeed beneficial to the properties of bulk solidifying amorphous alloys especially to the toughness. The volume fraction of such beneficial (or non-detrimental) crystalline precipitates in the amorphous alloys can be substantial. Such bulk amorphous alloys comprising such beneficial precipitates are also included in the current invention. One exemplary case is disclosed in (C. C. Hays et. al, Physical Review Letters, Vol. 84, p 2901, 2000), the disclosure of which is incorporated herein by reference. The current invention includes bulk solidifying amorphous alloys with a Poisson's ratio of 0.38 that are combined with a second phase (which might be a phase mixture) where the volume fraction of the bulk solidifying amorphous alloy is at least 10%.

The stress strain behavior of bulk solidifying amorphous alloys is characterized by a large elastic region of up to 2% elastic strain and a very high yield strength. The absence of crystal-slip mechanisms in B-SA Alloys leads to very high yield strength values close to the theoretical limit in bulk solidifying alloys. For example, bulk solidifying alloys do not show strain hardening during deformation as crystalline (ductile) metals do, but instead exhibit strain softening and thermal softening due to adiabatic heating. Upon yielding, however, the bulk solidifying amorphous material deforms in a highly localized manner and typically fails along one or a few shear bands. For example, in an unconfined geometry, failure of the B-SA Alloy occurs typically along a single shear band that cuts across the sample at an angle of 45° (direction of maximum resolved shear stress) with respect to the compression axis. This limits the global plasticity of B-SA Alloys in unconfined geometries to less than 1% and restricts the use of B-SA Alloys as a structural material for most applications. In addition, this prevents most bulk solidifying amorphous alloys to have limited or no ductility at room temperature.

According to the current invention, when the Poisson's ratio (generally regarded as an elastic property) of B-SA Alloys is more than 0.38, improved mechanical properties are observed compared to commonly known bulk-solidifying amorphous alloys. As such, in one preferred embodiment the current invention is directed to any suitable B-SA Alloy where the bulk solidifying alloy has a Poisson's ratio of 0.42 or larger. Herein, the Poisson's ratio is defined as the common definition of mechanics of materials, and is given by the negative of the ratio of the inward strain to the original tensile strain. The Poisson's ratio is related to other elastic properties of materials (e.g. bulk modulus, shear modulus etc.) by well-known equations as taught commonly in the courses of mechanics of materials. Poisson's ratio is typically measured indirectly by sound-wave measurements and using the well established equations relating elastic constants of materials.

It has been surprisingly discovered that alloy materials having a composition that falls within this Poisson's range exhibit improved mechanical properties, such as an extended ductility under compression with aspect ratios of greater than 2, and bend ductility with section thickness more than 2.0 mm.

The high Poisson's ratio also affects the fracture toughness of the bulk solidifying alloy. A large Poisson's ratio implies a small ratio of shear modulus over the bulk modulus. A low shear modulus allows for shear collapse before the extensional instability of crack formation can occur. This causes the tip of a shear band to extend rather than initiate a crack, and results in plastic deformability of the material at room temperature. A large crack resistance also results in high fracture toughness. Accordingly, in one embodiment of the current invention the bulk solidifying amorphous alloy has a Poisson's ratio of 0.38 or higher and show a fracture toughness of K1c>35 MPa $m^{-1/2}$.

In one exemplary embodiment, the inventors surprisingly found that certain Pt-base bulk solidifying amorphous alloys show substantially improved mechanical properties, specifically higher ductility and toughness, compared to commonly known bulk-solidifying amorphous alloys. Accordingly, the present invention is also directed to certain Pt-based bulk-solidifying amorphous alloys, which are referred to as Pt-based alloys herein having Poisson's ratios within the specified ranges. The Pt-based alloys of the current invention are based on ternary Pt-based alloy systems and the extension of these ternary systems to higher order alloys by the addition of one or more alloying elements. Although additional components may be added to the Pt-based alloys of this invention, the basic components of the Pt-base alloy system are Pt, (Cu, Ni), and P.

The exemplary Pt-base bulk-solidifying amorphous alloys of the present invention have improved mechanical properties, and particularly comprising alloying additives of at least Ni, Cu and P, and more particularly where the composition of the alloy is substantially $Pt_{57.5}Cu_{14.7}Ni_{5.3}P_{22.5}$ Toughness is a very desirable property for most applications. Bulk solidifying amorphous alloys typically show a toughness below 20 MPa $m^{-1/2}$. In one embodiment the bulk solidifying amorphous alloy $Pt_{57.5}Cu_{14.7}Ni_{5.3}P_{22.5}$ shows a fracture toughness of K1c>70 MPa $m^{-1/2}$. The high toughness value also reflect in the large critical crack radius which are typically highly unusual for bulk solidifying amorphous alloys. In still another embodiment the bulk solidifying amorphous alloy $Pt_{57.5}Cu_{14.7}Ni_{5.3}P_{22.5}$ has a critical crack radius of 4 mm. In yet another embodiment the bulk solidifying amorphous alloy $Pt_{57.5}Cu_{14.7}Ni_{5.3}P_{22.5}$ can be plastically deformed under bending conditions by more than 2% for sample thicknesses up to 4 mm.

Although $Pt_{57.5}Cu_{14.7}Ni_{5.3}P_{22.5}$ is a particularly preferred Pt-base alloy, a number of different Pt—(Cu, Ni)—P combinations may be utilized in the Pt-based alloys of the current invention. For example, to increase the ease of casting such alloys into larger bulk objects, and for increased processability, a mid-range of Pt content from about 25 to about 60 atomic percentage, a mid range of (Cu, Ni) content from about 20 to about 55 atomic percentage, and a mid range of P content from about 17 to about 23 atomic percent are preferred. Accordingly, in one embodiment of the invention, the Pt-based alloys of the current invention contain: Pt in the range of from about 20 to about 65 atomic percentage; (Cu, Ni) in the range of from about 15 to about 60 atomic percentage; and P in the range of from about 16 to about 24 atomic percentage. Still more preferable is a Pt-based alloy having a Pt content from about 35 to about 50 atomic percent, a (Cu, Ni) content from about 30 to about 45 atomic percentage, and a P content in the range of from about 18 to about 22 atomic percentage.

In another embodiment, the Pt-based alloys of the current invention contain a Pt content of up to about 65 atomic percentage. Such alloys are preferred in applications which require higher density and more noble-metal properties, such as in the production of fine jewelry. In contrast, lower Pt content is preferred for lower cost and lower density application.

Applicants have found that having a mixture of Ni and Cu in the Pt-based alloys of the current invention improve the ease of casting into larger bulk objects and also increase the processability of the alloys. Although, the Cu to Ni ratio can be as low as about 0.1, a preferable range of Cu to Ni ratio is in the range of from about 1 to about 4. The most preferable Cu to Ni ratio for increased processability is around 3.

Another highly preferred additive alloying element is Pd. When Pd is added, it should be added at the expense of Pt, where the Pd to Pt ratio can be up to about 4 when the total Pt and Pd content is less than about 40 atomic percentage, up to 6 when the total Pt and Pd content is in the range of from about 40 to about 50 atomic percentages, and up to 8 when the total Pt and Pd content is more than about 50 atomic percentage. Pd is also preferred for lower cost and lower density applications.

Co is another preferred additive alloying element for improving the processability of the Pt-based alloys of the current invention, particularly in the absence of Ni. Co can also be used as a substitute for Ni, when lower Ni content is desired to prevent allergic reactions in applications that require exposure to human body. Co should be treated as a substitute for Nickel, and when added it should be done at the expense of Ni and/or Cu. The ratio of Cu to the total of Ni and Co can be as low as about 0.1. A preferred range for the ratio of Cu to the total of Ni and Co is in the range of from about 1 to about 4. For increased processability, the most preferable ratio of Cu to the total of Ni and Co is around 3.0. In turn the Ni to Co ratio can be in the range of about 0 to about 1. For increased processability, the most preferable ratio of Ni to Co is around 3.0.

Si is still another preferred additive alloying element for improved the processability of the Pt-based alloys of the current invention. The Si addition is also preferred for increasing the thermal stability of the alloys in the viscous liquid regime above the glass transition. Si addition can increase the $\Delta T$ of an alloy, and, as such, the alloy's thermal stability against crystallization in the viscous liquid regime. Si addition should be done at the expense of P, where the Si to P ratio can be up to about 1.0. Preferably, the Si to P ratio is less than about 0.25. The effect of Si on the thermal stability around the viscous liquid regime can be observed at Si to P ratios as low as about 0.05 or less.

B is yet another additive alloying element for improving the processability and for increasing the thermal stability of the Pt-based alloys of the current invention in the viscous liquid regime above the glass transition. B should be treated as similar to Si, and when added it should be done at the expense of Si and/or P. For increased processability, the content of B should be less than about 5 atomic percentage and preferably less than about 3 atomic percentage.

It should be understood that the addition of the above mentioned additive alloying elements may have a varying degree of effectiveness for improving the processability in the spectrum of alloy composition range described above and below, and that this should not be taken as a limitation of the current invention.

The Co, Si and B additive alloying elements can also improve certain physical properties such as hardness, yield strength and glass transition temperature. A higher content of these elements in the Pt-based alloys of the current invention is preferred for alloys having higher hardness, higher yield strength, and higher glass transition temperature.

An additive alloying element of potential interest is Cr. The addition of Cr is preferred for increased corrosion resistance especially in aggressive environment. However, the addition of Cr can degrade the processability of the final alloy and its content should be limited to less than about 10 atomic percent and preferably less than about 6 atomic percent. When additional corrosion resistance is not specifically desired, the addition of Cr should be avoided. Cr should be added at the expense of Cu group (Cu, Ni, and Co).

Other additive alloying elements of interest are Ir and Au. These elements can be added as a fractional replacement of Pt. The total amount of these elements should be less than about 10 atomic percentage and preferably less than about 5 atomic percentage. These elements can be added to increase the jewelry value at low Pt contents.

Other alloying elements of potential interest are Ge, Ga, Al, As, Sn and Sb, which can be used as a fractional replacement of P or a P group element (P, Si and B). The total addition of such elements as replacements for a P group element should be less than about 5 atomic percentage and preferably less than about 2 atomic percentage.

Other alloying elements can also be added, generally without any significant effect on processability when their total amount is limited to less than 2%. However, a higher amount of other elements can cause the degrading of processability, especially when compared to the processability of the exemplary alloy compositions described below. In limited and specific cases, the addition of other alloying elements may improve the processability of alloy compositions with marginal critical casting thicknesses of less than 1.0 mm. It should be understood that such alloy compositions are also included in the current invention.

Given the above discussion, in general, the Pt-base alloys of the current invention can be expressed by the following general formula (where a, b, c are in atomic percentages and x, y, z are in fractions of whole):

$$((Pt,Pd)_{1-x}PGM_x)_a((Cu,Co,Ni)_{1-y}TM_y)_b((P,Si)_{1-z}X_z)_c,$$

where a is in the range of from about 20 to about 65, b is in the range of about 15 to about 60, c is in the range of about 16 to about 24 in atomic percentages, provided that the Pt content is at least about 10 atomic percentage, the total of Ni and Co content is a least about 2 atomic percentage, and the P content is at least 10 atomic percentage. PGM is selected from the group of Ir, Os, Au, W, Ru, Rh, Ta, Nb, Mo; and TM is selected from the group of Fe, Zn, Ag, Mn, V; and X is selected from the group of B, Al, Ga, Ge, Sn, Sb, As. The following constraints are given for the x, y and z fraction:

z is less than about 0.3, and the sum of x, y and z is less than about 0.5, and when a is less than about 35, x is less than about 0.3 and y is less than about 0.1 when a is in the range of from about 35 to about 50, x is less than about 0 to about 0.2 and y is less than about 0.2.

when a is more than about 50, x is less than about 0 to about 0.1 and y is less than about 0.3.

Preferably, the Pt-based alloys of the current invention are given by the formula:

$$((Pt,Pd)_{1-x}PGM_x)_a((Cu,Co,Ni)_{1-y}TM_y)_b((P,Si)_{1-z}X_z)_c,$$

a is in the range of from about 25 to about 60, b in the range of about 20 to about 55, c is in the range of about 16 to about 22 in atomic percentages, provided that the Pt content is at least about 10 atomic percentage, the total of Ni and Co content is a least about 2 atomic percentage, and the P content is at least 10 atomic percentage. PGM is selected from the group of Ir, Os, Au, W, Ru, Rh, Ta, Nb, Mo; and TM is selected from the group of Fe, Zn, Ag, Mn, V; and X is selected from the group of B, Al, Ga, Ge, Sn, Sb, As. The following constraints are given for the x, y and z fraction:

z is less than about 0.3, and the sum of x, y and z is less than about 0.5, and when a is less than about 35, x is less than about 0.3 and y is less than about 0.1 when a is in the range of from about 35 to about 50, x is less than about 0 to about 0.2 and y is less than about 0.2.

when a is more than about 50, x is less than about 0 to about 0.1 and y is less than about 0.3.

Still more preferable the Pt-based alloys of the current invention are given by the formula:

$$((Pt,Pd)_{1-x}PGM_x)_a((Cu,Co,Ni)_{1-y}TM_y)_b((P,Si)_{1-z}X_z)_c,$$

a is in the range of from about 35 to about 50, b in the range of about 30 to about 45, c is in the range of from about 18 to about 20 atomic percentages, provided that the Pt content is at least about 10 atomic percentage, the total of Ni and Co content is a least about 2 atomic percentage, and the P content is at least 10 atomic percentage. PGM is selected from the group of Ir, Os, Au, W, Ru, Rh, Ta, Nb, Mo; and TM is selected from the group of Fe, Zn, Ag, Mn, V; and X is selected from the group of B, Al, Ga, Ge, Sn, Sb, As. The following constraints are given for the x, y and z fraction:

z is less than about 0.3, and the sum of x, y and z is less than about 0.5, and x is less than about 0 to about 0.2, and;

y is less than about 0.2.

For increased processability, the above mentioned alloys are preferably selected to have four or more elemental components. The most preferred combination of components for Pt-based quaternary alloys of the current invention are Pt, Cu, Ni and P; Pt, Cu, Co and P; Pt, Cu, P and Si; Pt, Co, P and Si; and Pt, Ni, P and Si.

The most preferred combinations for five component Pt-based alloys of the current invention are: Pt, Cu, Ni, Co and P; Pt, Cu, Ni, P and Si; Pt, Cu, Co, P, and Si; Pt, Pd, Cu, Co and P; Pt, Pd, Cu, Ni and P; Pt, Pd, Cu, P, and Si; Pt, Pd, Ni, P, and Si; and Pt, Pd, Co, P, and Si.

Provided these preferred compositions, a preferred range of alloy compositions can be expressed with the following formula:

$$(Pt_{1-x}Pd_x)_a(Cu_{1-y}(Ni,Co)_y)_b(P_{1-z}Si_z)_c,$$

where a is in the range of from about 20 to about 65, b in the range of about 15 to about 60, c is in the range of about 16 to about 24 in atomic percentages; preferably a is in the range of from about 25 to about 60, b in the range of about 20 to about 55, c is in the range of about 16 to about 22 in atomic percentages; and still most preferably a is in the range of from about 35 to about 50, b in the range of about 30 to about 45, c is in the range of about 18 to about 20 in atomic percentages. Furthermore, x is in the range from about 0.0 to about 0.8, y is in the range of from about 0.05 to about 1.0, and z is in the range of from about 0.0 to about 0.4; and preferably, x is in the range from about 0.0 to about 0.4, y is in the range of from about 0.2 to about 0.8, and z is in the range of from about 0.0 to about 0.2.

A still more preferred range of alloy compositions can be expressed with the following formula:

$$Pt_a(Cu_{1-y}Ni_y)_bP_c,$$

where a is in the range of from about 20 to about 65, b is in the range about of 15 to about 60, c is in the range of about 16 to about 24 in atomic percentages; preferably a is in the range of from about 25 to about 60, b in the range of about 20 to about 55, c is in the range of about 16 to about 22 in atomic percentages; and still most preferably a is in the range of from about 35 to about 50, b in the range of about 30 to about 45, c is in the range of about 18 to about 20 in atomic percentages. Furthermore, y is in the range of about 0.05 to about 1.0; and preferably y is in the range of from about 0.2 to about 0.8.

Because of the high processability, high hardness and yield strength, and intrinsic metal value of these Pt-based alloys, they are particularly useful for general jewelry and ornamental applications. The following disclosed alloys are especially desired for such jewelry and ornamental applications due to their Pt content, good mechanical properties (high hardness and yield strength), high processability and low melting temperatures of less than 800° C.

$$(Pt_{1-x}Pd_x)_a(Cu_{1-y}(Ni,Co)_y)_b(P_{1-z}Si_z)_c,$$

where a is in the range of from about 35 to about 65, b in the range of about 15 to about 45, c is in the range of about 16 to about 24 in atomic percentages; preferably a is in the range of from about 40 to about 60, b in the range of about 20 to about 40, c is in the range of about 16 to about 22 in atomic percentages; and still most preferably a is in the range of from about 45 to about 60, b in the range of about 20 to about 35, c is in the range of about 18 to about 20 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

A still more preferred range of alloy compositions for jewelry applications can be expressed with the following formula:

$$Pt_a(Cu_{1-y}Ni_y)_bP_c,$$

where a is in the range of from about 35 to about 65, b in the range of about 15 to about 45, c is in the range of about 16 to about 24 in atomic percentages; preferably a is in the range of from about 40 to about 60, b in the range of about 20 to about 40, c is in the range of about 16 to about 22 in atomic percentages; and still most preferably a is in the range of from about 45 to about 60, b in the range of about 20 to about 35, c is in the range of about 18 to about 20 in atomic percentages. Furthermore, y is in the range of about 0.05 to about 1.0; and preferably, y is in the range of from about 0.2 to about 0.8.

A particularly desired alloy composition for jewelry applications are alloy compositions lacking any Ni, according to:

$$(Pt_{1-x}Pd_x)_a(Cu_{1-y}Co_y)_b(P_{1-z}Si_z)_c,$$

where a is in the range of from about 35 to about 65, b in the range of about 15 to about 45, c is in the range of about 16 to about 24 in atomic percentages; preferably a is in the range of from about 40 to about 60, b in the range of about 20 to about 40, c is in the range of about 16 to about 22 in atomic percentages; and still most preferably a is in the range of from about 45 to about 60, b in the range of about 20 to about 35, c is in the range of about 18 to about 20 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

And still more preferable Ni-free alloy compositions are:

$$Pt_a(Cu_{1-y}Co_y)_bP_c,$$

where a is in the range of from about 35 to about 65, b in the range of about 15 to about 45, c is in the range of about 16 to about 24 in atomic percentages; preferably a is in the range of from about 40 to about 60, b in the range of about 20 to about 40, c is in the range of about 16 to about 22 in atomic percentages; and still most preferably a is in the range of from about 45 to about 60, b in the range of about 20 to about 35, c is in the range of about 18 to about 20 in atomic percentages. Furthermore, y is in the range of about 0.05 to about 1.0; and preferably, y is in the range of from about 0.2 to about 0.8.

For high value jewelry applications, where Pt content (or the total precious metal content) of more than 75 weight % is desired, the following disclosed alloys are desired due to their very high processability, high Pt content, good mechanical properties (high hardness and yield strength), and low melting temperatures of less than 800° C.

$$(Pt_{1-x}Pd_x)_a(Cu_{1-y}(Ni,Co)_y)_b(P_{1-z}Si_z)_c,$$

where a is in the range of from about 35 to about 55, b in the range of about 20 to about 45, c is in the range of about 17 to about 25 in atomic percentages and preferably a is in the range of from about 40 to about 45, b in the range of about 32 to about 40, c is in the range of about 19 to about 23 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

A still more preferred range of alloy compositions for jewelry applications can be expressed with the following formula:

$$Pt_a(Cu_{1-y}Ni_y)_bP_c,$$

where a is in the range of from about 35 to about 55, b in the range of about 20 to about 45, c is in the range of about 17 to about 25 in atomic percentages and preferably a is in the range of from about 40 to about 45, b in the range of about 32 to about 40, c is in the range of about 19 to about 23 in atomic percentages. Furthermore, y is in the range of about 0.05 to about 1.0; and preferably, y is in the range of from about 0.2 to about 0.8.

A particularly desired alloy composition for jewelry applications are alloy compositions lacking any Ni, according to:

$$(Pt_{1-x}Pd_x)_a(Cu_{1-y}Co_y)_b(P_{1-z}Si_z)_c,$$

where a is in the range of from about 35 to about 55, b in the range of about 20 to about 45, c is in the range of about 17 to about 25 in atomic percentages and preferably a is in the range of from about 40 to about 45, b in the range of about 32 to about 40, c is in the range of about 19 to about 23 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

And still more preferable Ni-free alloy compositions are:

$$Pt_a(Cu_{1-y}Co_y)_bP_c,$$

where a is in the range of from about 35 to about 55, b in the range of about 20 to about 45, c is in the range of about 17 to about 25 in atomic percentages and preferably a is in the range of from about 40 to about 45, b in the range of about 32 to about 40, c is in the range of about 19 to about 23 in atomic percentages. Furthermore, y is in the range of about 0.05 to about 1.0; and preferably, y is in the range of from about 0.2 to about 0.8.

For high value jewelry applications, where Pt content (or the total precious metal content) of more than 85 weight % is desired, the following disclosed alloys are desired due to their very high Pt content, good mechanical properties (high hardness and yield strength), high processability and low melting temperatures of less than 800° C.

$$(Pt_{1-x}Pd_x)_a(Cu_{1-y}(Ni,Co)_y)_b(P_{1-z}Si_z)_c,$$

where a is in the range of from about 55 to about 65, b in the range of about 15 to about 25, c is in the range of about 17 to about 25 in atomic percentages and preferably a is in the range of from about 57 to about 62, b in the range of about 17 to about 23, c is in the range of about 19 to about 23 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

A still more preferred range of alloy compositions for jewelry applications can be expressed with the following formula:

$$Pt_a(Cu_{1-y}Ni_y)_bP_c,$$

where a is in the range of from about 55 to about 65, b in the range of about 15 to about 25, c is in the range of about 17 to about 25 in atomic percentages and preferably a is in the range of from about 57 to about 62, b in the range of about 17 to about 23, c is in the range of about 19 to about 23 in atomic percentages. Furthermore, y is in the range of about 0.05 to about 1.0; and preferably, y is in the range of from about 0.2 to about 0.8.

A particularly desired alloy composition for jewelry applications are alloy compositions lacking any Ni, according to:

$$(Pt_{1-x}Pd_x)_a(Cu_{1-y}Co_y)_b(P_{1-z}Si_z)_c,$$

where a is in the range of from about 55 to about 65, b in the range of about 15 to about 25, c is in the range of about 17 to about 25 in atomic percentages and preferably a is in the range of from about 57 to about 62, b in the range of about 17 to about 23, c is in the range of about 19 to about 23 in atomic percentages. Furthermore, x is in the range from about 0.0 to about 0.4, y is in the range of from about 0.05 to about 1.0, and z is in the range of from about 0.0 to about 0.4; and preferably, x is in the range from about 0.0 to about 0.1, y is in the range of from about 0.2 to about 0.8, and z is in the range of from about 0.0 to about 0.2.

And still more preferable Ni-free alloy compositions are:

$$Pt_a(Cu_{1-y}Co_y)_bP_c,$$

where a is in the range of from about 55 to about 65, b in the range of about 15 to about 25, c is in the range of about 17 to about 25 in atomic percentages and preferably a is in the range of from about 57 to about 62, b in the range of about 17 to about 23, c is in the range of about 19 to about 23 in atomic percentages. Furthermore, y is in the range of about 0.05 to about 1.0; and preferably, y is in the range of from about 0.2 to about 0.8.

A particularly preferred embodiment of the invention comprises a five component formulation of Pt, Co, Ni, Cu and P and may be utilized for a highly processable Pt alloy with at least 75% by weight Pt.

These formulations comprise a mid-range of Pt content from about 39 to about 50 atomic percentage, a mid range of Ni content from about 0 to 15 atomic percent, a mid range of Co content from 0 to 15 atomic percent, a mid range of Cu content from about 16 to about 35 atomic percentage, and a mid range of P content from about 17 to about 25 atomic percent are preferred. In such an embodiment, the sum of the Ni and Co content should be above 2 atomic percent.

Still more preferable is a five component Pt-based alloy having a Pt content from about 41 to about 47 atomic percent, a Ni content from about 0 to 13 atomic percent, a Co content from about 0 to 8 atomic percent, a Cu content from about 12 to about 16 atomic percentage, and a P content in the range of from about 19 to about 23 atomic percentage. Again in such an embodiment, the sum of the Ni and Co content should be above 2 atomic percent.

In another embodiment of the invention a four component Pt—Co—Cu—P alloy may be utilized for a Ni-free Pt-based alloy. In one such embodiment, the alloy has at least 75% by weight platinum. To increase the ease of casting such alloys into larger bulk objects, and for or increased processability, a mid-range of Pt content from about 39 to about 50 atomic percentage, a mid range of Co content from 0 to 15 atomic percent, a mid range of Cu content from about 16 to about 35 atomic percentage, and a mid range of P content from about 17 to about 25 atomic percent are preferred.

Still more preferable is a four component Pt-based alloy having a Pt content from about 41 to about 47 atomic percent, a Co content from about 1 to 10 atomic percent, a Cu content from about 12 to about 16 atomic percentage, and a P content in the range of from about 19 to about 23 atomic percentage.

In still another embodiment different Pt—Co—Ni—Cu—P combinations may be utilized for a highly processable Pt-based alloys with a platinum content of 85 weight percent of higher. To increase the ease of casting such alloys into larger bulk objects, and for increased processability, a mid-range of Pt content from about 54 to about 64 atomic percentage, a mid range of Ni content from about 1 to 12 atomic percent, a mid range of Co content from about 0 to 8 atomic percent, a mid range of Cu content from about 9 to about 20 atomic percentage, and a mid range of P content from about 17 to about 24 atomic percent are preferred. In such an embodiment, as before, the sum of the Ni and Co content should be above 2 atomic percent.

Still more preferable is a Pt-based alloy having a Pt content from about 56 to about 62 atomic percent, a Ni content from about 2 to 6 atomic percent, a Co content from 0 to 5 atomic percent, a Cu content from about 12 to about 16 atomic percentage, and a P content in the range of from about 19 to about 23 atomic percentage.

In another embodiment, a number of different Pt—Co—Cu—P combinations may be utilized for a Ni-free Pt-based alloys with a Pt-content of at least 85 weight percent. To increase the ease of casting such alloys into larger bulk objects, and for or increased processability, a mid-range of Pt content from about 55 to about 65 atomic percentage, a mid range of Co content from about 1 to about 10 atomic percentage, a mid range of Cu content from about 9 to about 20 atomic percentage, and a mid range of P content from about 17 to about 24 atomic percent are preferred.

Still more preferable is a Pt-based alloy having a Pt content from about 58 to about 62 atomic percent, a Co content from about 4 to 1.5 atomic percent, a Cu content from about 14 to about 17 atomic percentage, and a P content in the range of from about 19 to about 23 atomic percentage.

Given the above discussion, in general, the highly processable Pt-base alloys of the current invention that contain at least 75% by weight of Pt can be expressed by the following general formula (where a, b, c are in atomic percentages):

$$Pt_aNi_bCo_eCu_cP_d,$$

where a is in the range of from about 39 to about 50, b is in the range of about 1 to about 15, c is in the range of about 16 to about 36, d is in the range of about 17 to 25, and e is in the range of about 0 to 15 in atomic percentages, where the sum of b and e should be at least 2 atomic percent.

Still more preferable the highly processable Pt-based alloys which contains at least 75% by weight of platinum of the current invention are given by the formula:

$$Pt_aNi_bCo_eCu_cP_d,$$

where a is in the range of from about 41 to about 47, b in the range of about 0 to about 13, c is in the range of about 12 to about 16, d in the range of 19 to 23, and e in the range of 0 to 8 in atomic percentages, and where the sum of b and e should be at least 2 atomic percent.

Given the above discussion, in general, the Pt-base Ni free alloys of the current invention that consists of at least 75 weight percent of platinum can be expressed by the following general formula (where a, b, c are in atomic percentages):

$$Pt_aCo_bCu_cP_d,$$

where a is in the range of from about 39 to about 50, b is in the range of about 1 to about 5, c is in the range of about 16 to about 35, and d is in the range about of 17 to 25 atomic percentages.

Still more preferable the Pt-based Ni free alloys which consists of at least 75% by weight of the current invention are given by the formula:

$$Pt_aCo_bCu_cP_d,$$

where a is in the range of from about 41 to about 47, b is in the range of about 1 to about 10, c is in the range of about 12 to about 16, and d is in the range of about 19 to 23 in atomic percentages.

Given the above discussion, in general, the highly processable Pt-base alloys of the current invention that contains at least 85% by weight of Pt can be expressed by the following general formula (where a, b, c are in atomic percentages):

$$Pt_aNi_bCo_eCu_cP_d,$$

where a is in the range of from about 54 to about 64, b is in the range of about 1 to about 12, c is in the range of about 9 to about 20, d is in the range of about 17 to 24, and e is in the range of about 0 to about 8 in atomic percentages, and where the sum of b and e should be at least 2 atomic percent.

Still more preferable the highly processable Pt-based alloys which contains at least 85% by weight of platinum of the current invention are given by the formula:

$$Pt_aNi_bCo_eCu_cP_d,$$

where a is in the range of from about 56 to about 62, b is in the range of about 2 to about 6, c is in the range of about 12 to about 16, d is in the range of about 19 to 23, and e is in the range of about 0 to 5 in atomic percentages, and where the sum of b and e should be at least 2 atomic percent.

Given the above discussion, in general, the Pt-base Ni free alloys of the current invention that consists of at least 85 weight percent of platinum can be expressed by the following general formula (where a, b, c are in atomic percentages):

$$Pt_aCo_bCu_cP_d,$$

where a is in the range of from about 55 to about 65, b is in the range of about 1 to about 10, c is in the range of about 9 to about 20, and d is in the range of about 17 to 24 in atomic percentages.

Still more preferable the Pt-based Ni free alloys which consists of at least 85% by weight of the current invention are given by the formula:

$$Pt_aCo_bCu_cP_d,$$

where a is in the range of from about 58 to about 62, b is in the range of about 1.5 to about 4, c is in the range of about 14 to about 17, and d is in the range of about 19 to 23 in atomic percentages.

EXAMPLES

Example 1

Highly Processable Pt-Base Alloys

The following alloy compositions are exemplary compositions for highly processable Pt-based alloys with a Pt-content of at least 75 percent by weight. The glass transition temperatures, the crystallization temperature, supercooled liquid region, liquidus temperature, the reduced glass temperature Trg=Tg/TL, the Vickers hardness number, the critical casting thickness, and the alloys density are summarized in Table 1, below. In addition, x-ray diffraction was utilized to verify the amorphous structure of all four alloys.

FIG. 1 shows the time temperature transformation diagram of the $Pt_{44}Cu_{26}Ni_9P_{21}$ alloy. This diagram shows the time to reach crystallization in an isothermal experiment at a given temperature. For example, at 280° C. it takes 14 min before crystallization sets in. At this temperature the alloy can be processed for 14 min before it crystallized. Bulk solidifying amorphous alloys, however have a strong tendency to embrittle during isothermal processing in the supercooled liquid region. For example, the well studied Zr-based alloy Zr41T14Cu12Ni10Be23 exhibits a reduction in fracture toughness from 55 MPa $m^{-1/2}$ in the as cast state to 1 MPa $m^{-1/2}$ after annealing close to the crystallization event [C. J.Gilbert, R. J. Ritchie and W. L Johnson, Appl. Phys. Lett. 71, 476, 1997]. In fact the material embrittles solely by heating it up to the isothermal temperature and immediate cooling below Tg. In the current example the $Pt_{44}Cu_{26}Ni_9P_2$, alloy was isothermally processed at 280° C. for 1 min, 5, min, 16 min, and 30 min. The samples annealed for 1 min, 5 min, and 16 min do not show any noticeable difference in the fracture toughness compare to the as cast material. First, when a substantial fraction of the sample is crystallized (here almost 50%) the fracture toughness drops noticeable. This means that the onset time the TTT-diagram shown in FIG. 1 can also be regarded as the maximum processing time available before the material crystallizes and loses its superior properties.

TABLE 1

Properties of Pt-alloy having 75% weight content of Pt

| Alloy | TL [C.] | Tg [C.] | Tx [C.] | DT [C.] | Trg | Hardness, Vickers | density g/cm^3 | Critical casting thickness |
|---|---|---|---|---|---|---|---|---|
| $Pt_{44}Cu_{26}Ni_{10}P_{20}$ | 600 | 255 | 329 | 74 | 0.604811 | 400 | 11.56 | <14 mm |
| $Pt_{44}Cu_{24}Ni_{12}P_{20}$ | 590 | 253 | 331 | 78 | 0.609502 | 420 | 11.56 | <14 mm |
| $Pt_{44}Cu_{29}Ni_{7}P_{20}$ | 610 | 246 | 328 | 82 | 0.587769 | 390 | 11.57 | <16 mm |
| $Pt_{44}Cu_{26}Ni_{9}P_{21}$ | 600 | 242 | 316 | 74 | 0.58992 | 404 | 11.41 | <18 mm |

The alloy compositions shown in table 2, below, are exemplary compositions for highly processable Pt-based alloys with a Pt-content of at least 85 percent by weight.

TABLE 2

Exemplary Pt-alloy compositions having an 85% eight Pt content

| Alloy | TL [C.] | Tg [C.] | Tx [C.] | DT [C.] | Trg | Hardness Vickers | Density [g/cm$^3$] | Critical Casting thickness |
|---|---|---|---|---|---|---|---|---|
| $Pt_{56}Cu_{16}Ni_{8}P_{20}$ | 600 | 251 | 324 | 73 | 0.600229 | | 13.16 | <12 mm |
| $Pt_{88}Cu_{8}Ni_{4}P_{20}$ | 590 | 244 | 300 | 56 | 0.599073 | | 12.84 | >4 mm |
| $Pt_{57}Cu_{17}Ni_{8}P_{18}$ | 625 | 267 | 329 | 62 | 0.601336 | | 13.27 | <12 mm |
| $Pt_{57}Cu_{15}Ni_{6}P_{22}$ | 600 | 257 | 338 | 81 | 0.607102 | | 12.63 | <12 mm |
| $Pt_{57.3}Cu14.8Ni_{6}P_{21.9}$ | 600 | 257 | 338 | 81 | 0.607102 | | 12.68 | <12 mm |
| Pt57.5Cu14.7Ni5.3P22.5 | 560 | 235 | 316 | 81 | 0.609844 | | 12.61 | <16 mm |
| Pt57Cu14Ni5P24 | 560 | 225 | 290 | 65 | 0.597839 | | 12.33 | <10 mm |
| Pt58Cu16Ni4P22 | 555 | 232 | 304 | 72 | 0.609903 | | 12.73 | |
| Pt60Cu14Ni4P22 | 570 | 226 | 298 | 72 | 0.591934 | 378 | 12.94 | <12 mm |
| Pt58Cu12Ni8P22 | 540 | 228 | 290 | 62 | 0.616236 | | 12.74 | <12 mm |
| Pt59Cu15Ni6P20 | 550 | 229 | 298 | 69 | 0.609964 | | 13.15 | <12 mm |
| Pt60Cu16Ni2P22 | 550 | 229 | 308 | 79 | 0.609964 | 405 | 13.31 | <12 mm |
| Pt58.5Cu14.5Ni5P22 | 540 | 226 | 310 | 84 | 0.613776 | 395 | 12.78 | <12 mm |
| pt62cu13Ni3p22 | 600 | 225 | 275 | 50 | 0.570447 | | 13.14 | <12 mm |
| Pt58cu14Ni5P23 | 570 | 227 | 290 | 63 | 0.59312 | | 12.58 | <12 mm |
| Pt60Cu9Ni9P22 | 560 | 233 | 293 | 60 | 0.607443 | | 12.94 | >10 mm |
| Pt59Cu16Ni2P23 | 570 | 233 | 296 | 63 | 0.600237 | | 12.68 | <12 mm |
| pt61Cu16Ni2P21 | 570 | 230 | 285 | 55 | 0.596679 | 412 | 13.19 | >10 mm |
| Pt57.5Cu15.5Ni6P21 | 540 | 228 | 288 | 60 | 0.616236 | | 12.48 | <12 mm |
| Pt57.5Cu14.5Ni5P23 | 560 | 230 | 304 | 74 | 0.603842 | 380 | 12.53 | <12 mm |
| Pt60Cu20P20 | 587 | 231 | 280 | 49 | 0.586 | 374 | 13.24 | >2 mm |

The glass transition temperatures, the crystallization temperature, supercooled liquid region, liquidus temperature, the reduced glass temperature Trg=Tg/TL, Vickers hardness number, critical casting thickness, and the alloys density are also summarized in Table 2. It should be mentioned that a minimum of 2 at. % Ni is mandatory to obtain a large critical casting thickness. For less than 2 at. % Ni and/or Co the material is crystallized in a 2 mm tube.

Figure 2:
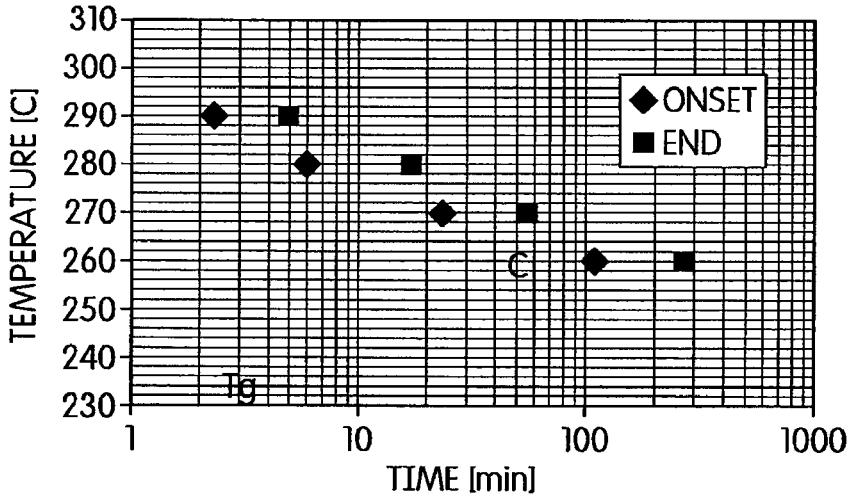
FIG. 2 shows a time temperature transformation diagram for an exemplary Pt-based amorphous alloy ($Pt_{57.5}Cu_{14.7}Ni_{5.3}P_{22.5}$)

FIG. 2 shows the time temperature transformation diagram of the $Pt_{57.5}Cu_{14.7}Ni_{5.3}P_{22.5}$ alloy. This diagram shows the time to reach crystallization in an isothermal experiment at a given temperature. For example at 280° C. it takes 6 min before crystallization sets in. At this temperature the alloy can be processed for 5 min before it crystallized. The $Pt_{57.5}Cu_{14.7}Ni_{5.3}P_{22.5}$ alloy was isothermally processed at 280° C. for 1 min, 3, min, 5 min, and 10 min. The samples annealed for 1 min, 3 min, and 5 min do not show any noticeable difference in the fracture toughness compare to the as cast material. First, when a substantial fraction of the sample crystallized (here almost 50%) the fracture toughness dropped noticeably. This means that the onset time of the TTT-diagram shown in FIG. 2 can be regarded also as the maximum processing time before the material crystallizes and looses it superior properties.

In order to determine the sensitivity to oxygen the alloy was processed in air and for comparison in an argon atmosphere at a temperature between Tg and Tx. After the processing both samples were still entirely amorphous. The free surface was subsequently studied with x-ray photoemission spectroscopy, a standard technique to determine surface chemistry. No measurable difference could be determined between the differently processed samples.

The following alloy compositions shown in Table 3 are exemplary compositions for Pt-based alloys with a Pt-content of at least 85 percent by weight that are Ni-free. The glass transition temperatures, the crystallization temperature, supercooled liquid region, liquidus temperature, the reduced glass temperature Trg=Tg/TL, the Vickers hardness number, critical casting thickness, and the alloys density are also summarized in Table 3. In addition, x-ray diffraction was utilized to verify the amorphous structure of all 3 alloys.

TABLE 3

| Exemplary Ni free Pt-alloy compositions having an 85% eight Pt content | | | | | | | | |
|---|---|---|---|---|---|---|---|---|
| Alloy | TL [C.] | Tg [C.] | Tx [C.] | DT [C.] | Trg | Hardness, Vickers | Critical casting thickness [mm] | density [g/cm$^3$] |
| $Pt_{58.5}Cu_{15}Co_4P_{22.5}$ | 640 | 280 | 320 | 40 | 0.606 | 358 | <8 mm | 12.7 |
| $Pt_{60}Cu_{16}Co_2P_{22}$ | 610 | 234 | 297 | 63 | 0.574 | 392 | >14 mm | 12.93 |
| Pt57.5Cu14.7Co5.3P22.5 | 662 | 287 | 332 | 45 | 0.59 | 413 | <4 mm | 12.6 |

The processability of three exemplary Pt-base alloys are shown in the Table 4, below, with reference to an inferior alloy. The critical casting thickness in a quarts tube to from fully amorphous phase is also shown. The alloying of these exemplary alloys can be carried out at the maximum temperature of 650 C. and can be flux-processed below 800° C. Their casting into various shapes can be done from temperatures as low as 700° C.

TABLE 4

| Comparison of Pt-based alloys | | | | | | | |
|---|---|---|---|---|---|---|---|
| Composition [at. %] | Tg [K] | Tx [K] | ΔT [K] | Tl [K] | Trg = Tl/Tg | $d_{max}$ quartz tube [mm] | Pt Content |
| $Pt_{57.5}Cu_{14.7}Ni_{5.3}P_{22.5}$ | 508 | 606 | 98 | 795 | 0.64 | 16 | >85 wt % |
| $Pt_{42.5}Cu_{27}Ni_{9.5}P_{21}$ | 515 | 589 | 74 | 873 | 0.59 | 20 | >75 wt % |
| $Pt_{60}Cu_{16}Co_2P_{22}$ | 506 | 569 | 63 | 881 | 0.58 | 16 | >85 w % |
| $Pt_{60}Cu_{20}P_{20}$ | | | | 844 | | <4 | Comparison of "inferior" alloy |

The alloying of the above-mentioned alloys was carried out in sealed containers, e.g., quartz tubes to avoid evaporation of phosphorous and thereby composition changes. The alloying temperature was chosen. By processing the alloy for 10 min at 50° C. above of the alloys liquidus temperature the constituents are completely alloyed into a homogeneous material. In order to improve the glass forming ability the alloys are subsequently processed in a fluxing material e.g. $B_2O_3$. This fluxing procedure depend on the flux material and for $B_2O_3$ it is 800° C. for 20 min. The material was cast in complicated shapes from 700° C.

Figure 3:
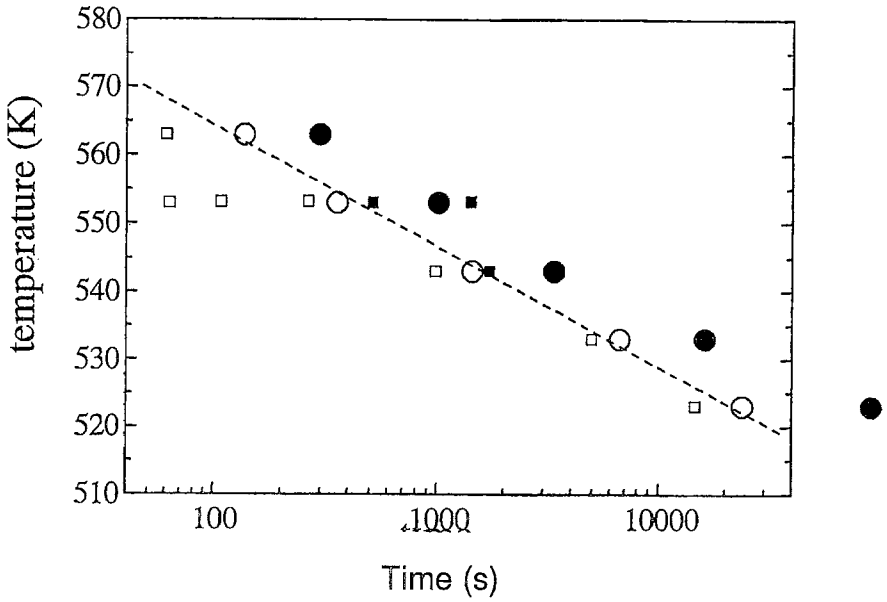
FIG. 3 shows a time temperature transformation diagram for an exemplary Pt-based amorphous alloy ($Pt_{57.5}Cu_{14.7}Ni_{5.3}P_{22.5}$) heated into the supercooled liquid region.

The embrittlement of the inventive alloys was studied under isothermal conditions for material heated into the supercooled liquid region. A time-temperature-transformation diagram for amorphous $Pt_{57.5}Cu_{14.7}Ni_{5.3}P_{22.5}$ alloy heated into the supercooled liquid region is provided in FIG. 3. Open circles depict onset of crystallization and closed circles the end of the crystallization. Squares indicate annealing conditions for failure mode determination. The open squares indicate a ductile behavior and the closed squares a brittle failure. The dashed line guides the eye to distinguish the region from ductile to brittle failure.

Plastic forming processing in the supercooled liquid region can be performed in air. The $Pt_{57.5}Cu_{14.7}Ni_{5.3}P_{22.5}$ alloy resistivity to oxidation was determined by processing both in air and in an argon atmosphere at 533 K for 30 min. Since with the naked eye no difference could be determined, x-ray photoemission spectroscopy (XPS) was utilized to determine oxidation, and it was determined that between the differently processed samples no difference in the XPS spectrum could be revealed.

Example 2

High Ductile Strength Pt-Base Alloys

In another exemplary embodiment, an alloy having a composition within the Poisson's ratio of 0.38 was formed to test the improved ductile properties of the inventive materials. In this embodiment the alloys had a composition of substantially $Pt_{57.5}Cu_{14.7}Ni_{5.3}P_{22.5}$.

Figure 4:
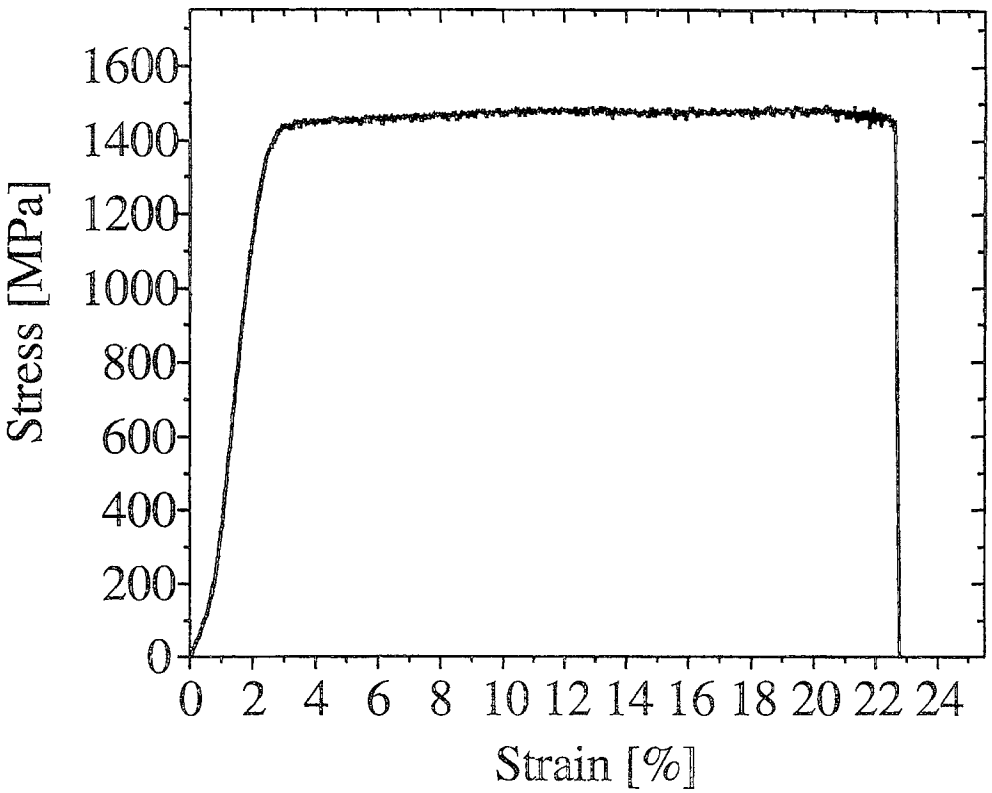
FIG. 4 shows a stress strain curve of amorphous monolithic $Pt_{57.5}Cu_{14.7}Ni_{5.3}P_{22.5}$.

In a first test, bar shaped samples with dimensions of 3 mm×3 mm×6 mm were machined for quasi-static ($\dot{\epsilon}=10^{-4}$ $s^{-1}$) compression tests. FIG. 4 shows the stress-strain curve of a $Pt_{57.5}Cu_{14.7}Ni_{5.3}P_{22.5}$ sample under compressive loading. Initially, it behaves like a typical B-SA Alloy, exhibiting an elastic strain limit of less than 2% at a yield stress of 1400 MPa. However, after reaching the maximum strength of 1470 MPa, the material deforms in a perfectly plastic manner. This has never been observed for B-SA Alloys which typically fail before any observable plastic deformation occurs. The plastic strain to failure was found to be 20%.

Figure 5:
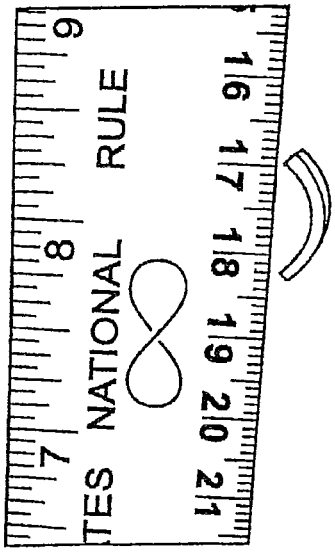
FIG. 5 shows optical micrographs of a $Pt_{57.5}Cu_{14.7}Ni_{5.3}P_{22.5}$ metallic glass that was plastically deformed to 15% strain.

Samples were polished prior to plastic deformation. FIG. 5 shows an optical micrograph of a sample that was loaded in compression to 15% strain. Typically, in an unconfined geometry the formation one shear band leads to failure of the B-SA Alloy. In this sample however, a large number of shear bands can be observed. In addition to the primary shear bands that form an angle of approximately 45° with respect to the compression axis, some secondary shear bands form with an angle of approximately 45° with respect to the primary bands. The average spacing of the primary bands is about 30 μm, and the average shear offset is about 1 μm.

Figure 6:
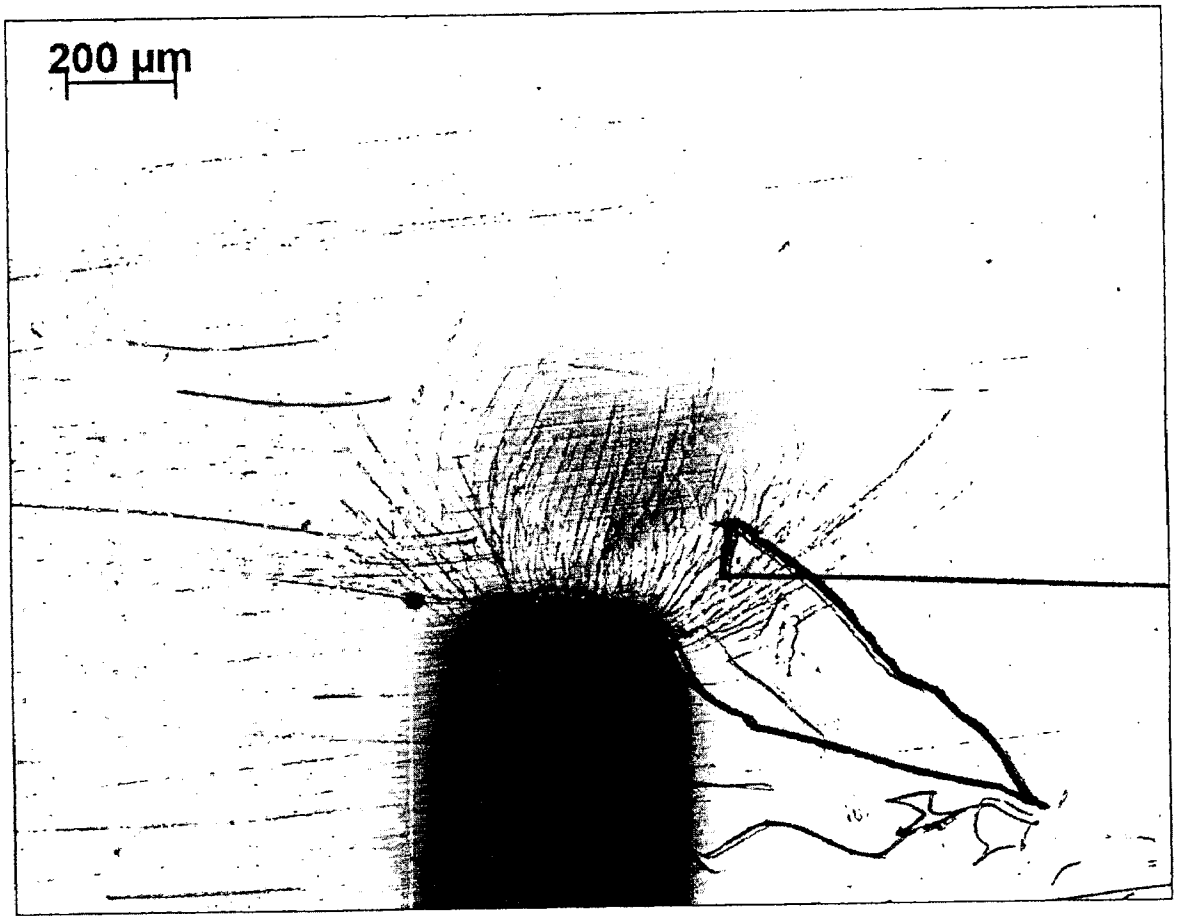
FIG. 6 shows the plastic zone ahead of the notch in a three point beam bending test

In order to investigate if the high ductility also leads to a high crack resistance, fracture toughness measurements were performed. Fracture toughness testing was conducted on 24 mm×6 mm×4 mm samples. The samples were pre-notched to a length of 3 mm with a notch radius of 50 μm. A standard three point beam geometry with a load rate of $10^{-6}$ m/s was used. Fracture toughness was calculated according to ASTM E399-90 standard. Two samples were tested and values of $K_{1c}$=79 MPa $m^{-1/2}$ and $K_{1c}$=84 MPa $m^{-1/2}$ were calculated. This very high $K_{1c}$ value is also reflected in the large plastic zone extending from the notch into the sample. FIG. 6 shows an image of the plastic zone measured on a sample with a notch radius of 200 μm. The size of the notch tip plastic zone (as defined by the extent of visible shear bands) is about 1.4 mm, nearly an order of magnitude larger than measured on Zr-based B-SA Alloys with fracture toughness values between $K_{1c}$=16-20 MPa $m^{-1/2}$ The critical crack radius can be calculated according to Equation 1:

$$a = \frac{2K_{1c}^2}{\sigma_y^2\sqrt{\pi}} \quad \text{(Eq. 1)}$$

with the measured $K_{1c}$=80 MPa $m^{-1/2}$ and $\sigma_y$=1400 MPa, a critical crack radius of 4 mm is calculated. This radius is about 40 times larger than the critical crack radius in a Zr-based B-SAA (100 μm). The large critical crack radius for $Pt_{57.5}Cu_{14.7}Ni_{5.3}P_{22.5}$ suggests that the material's mechanical properties are very insensitive to porosity and inclusions.

Figure 7B:
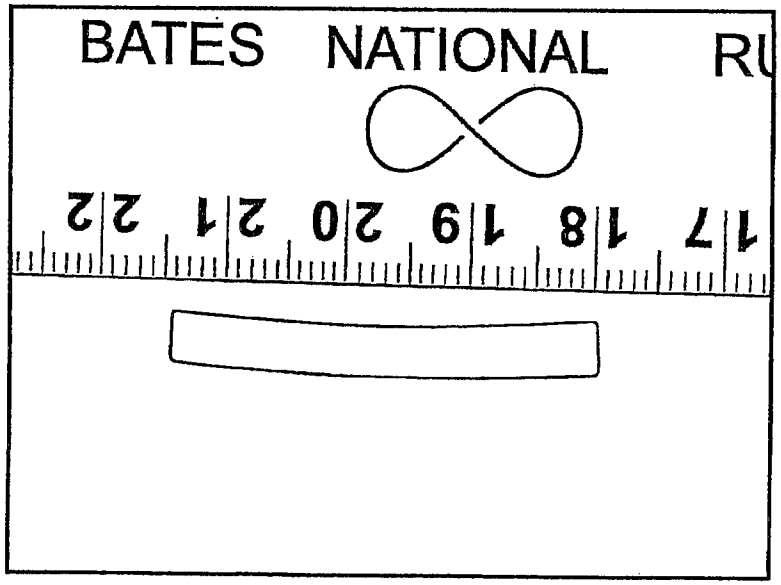
FIG. 7*b* shows a $Pt_{57.5}Cu_{14.7}Ni_{5.3}P_{22.5}$ sample with dimensions of 4 mm×4 mm×34 mm bent over a mandrel with a radius of 6 cm.
Figure 7A:
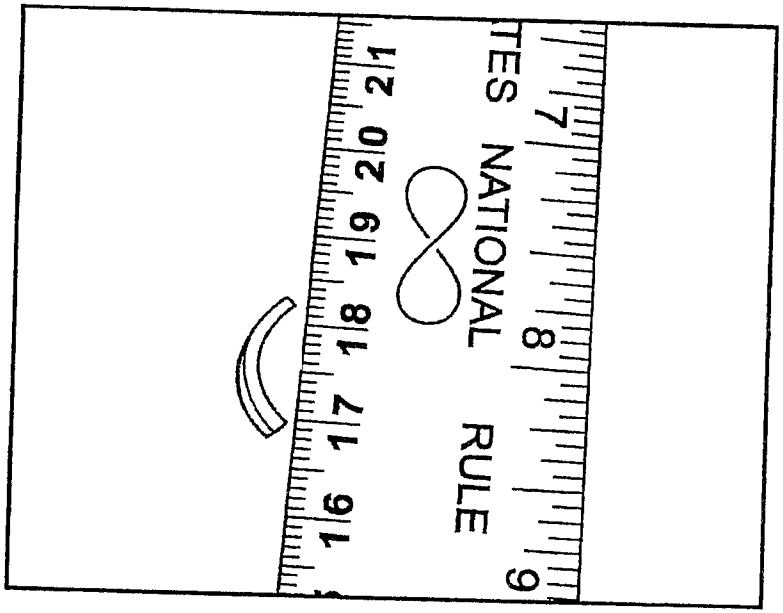
FIG. 7*a* shows a 1.8 mm×3 mm×15 mm bar shaped $Pt_{57.5}Cu_{14.7}Ni_{5.3}P_{22.5}$ sample bent over a mandrel of radius 6.35 mm.

Bending tests were performed on 4 mm×4 mm×35 mm, 2 mm×4 mm×15 mm, and 1.8 mm×3 mm×15 mm bar shaped samples that were bent around mandrels radius of 60 mm, 12.7 mm, 9.5 mm, and 6.35 mm. The 1.8 mm thick sample did not fail during bending over all four mandrels, as can be seen in FIG. 7*a*. The strain to failure can be calculated from $\epsilon$=h/2R, where R is the neutral radius of the bend sample and h the sample's thickness. For the 4 mm thick sample the strain to failure exceeds 3% as evidenced by the permanent deformation of the sample shown in FIG. 7*b*. A strain to failure between 10.5% and 15.7% was observed for the 2 mm thick sample, and the 1.8 mm sample exceeded 14.2% strain.

Figure 8A:
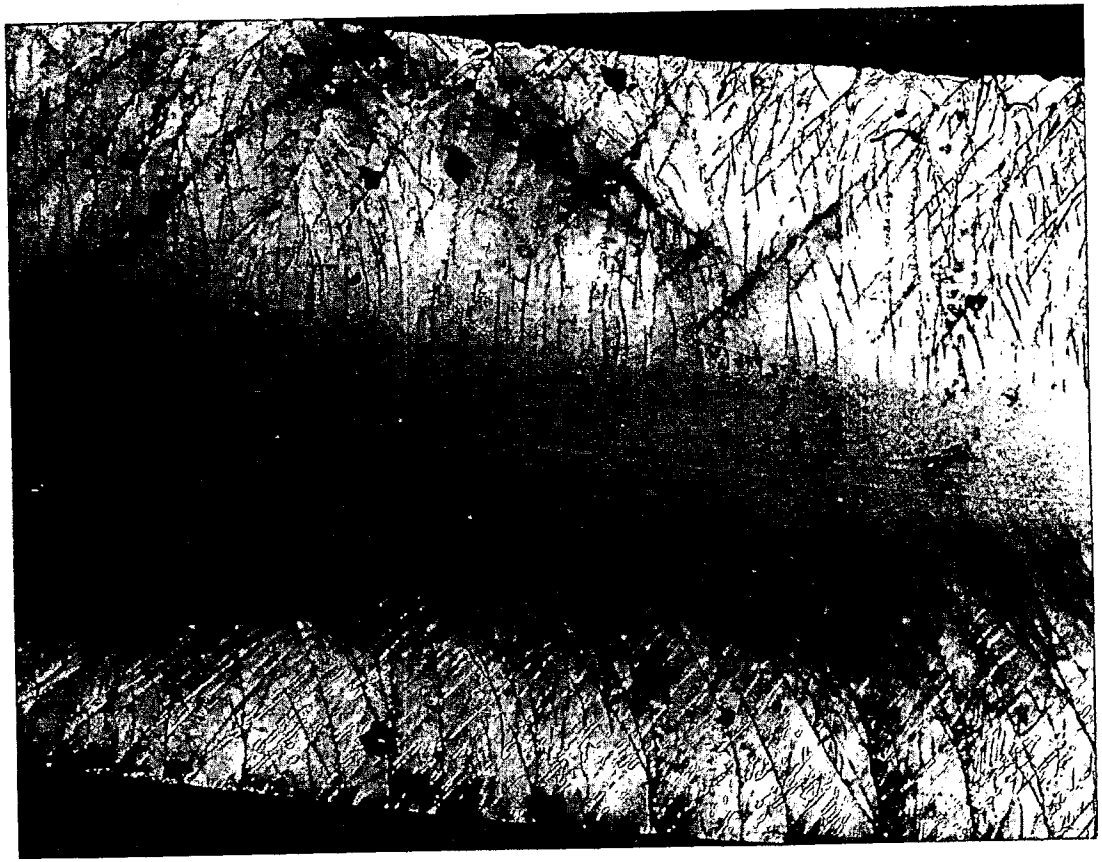
FIG. 8*a* shows an optical micrograph of a $Pt_{57.5}Cu_{14.7}Ni_{5.3}P_{22.5}$ B-SAA with dimensions of 1.8 mm×3 mm×15 mm which was bent over a mandrel of radius 12.7 mm.
Figure 8B:
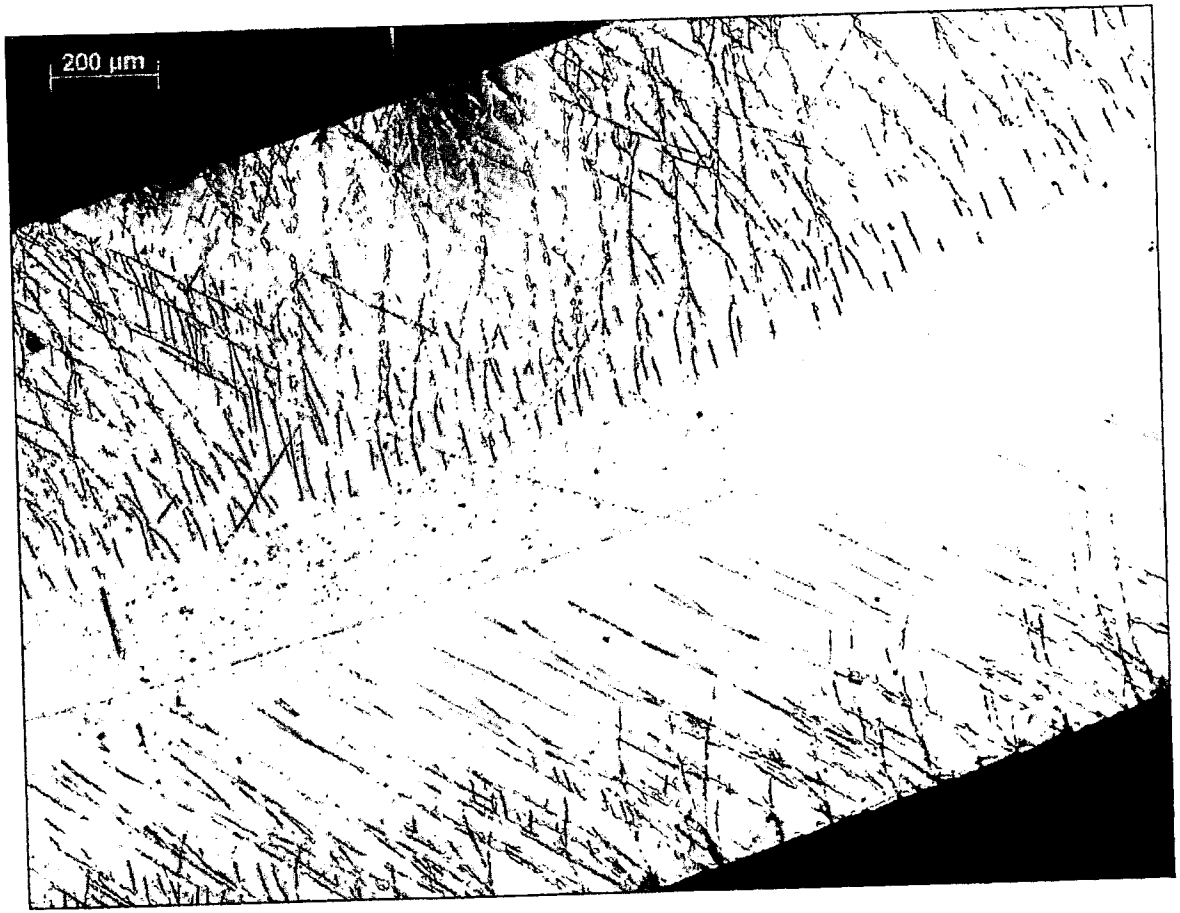
FIG. 8*b* shows an optical micrograph of a $Pt_{57.5}Cu_{14.7}Ni_{5.3}P_{22.5}$ B-SAA with dimensions of 1.8 mm×3 mm×15 mm which was bent over a mandrel with radius 9.5 mm.
Figure 8C:
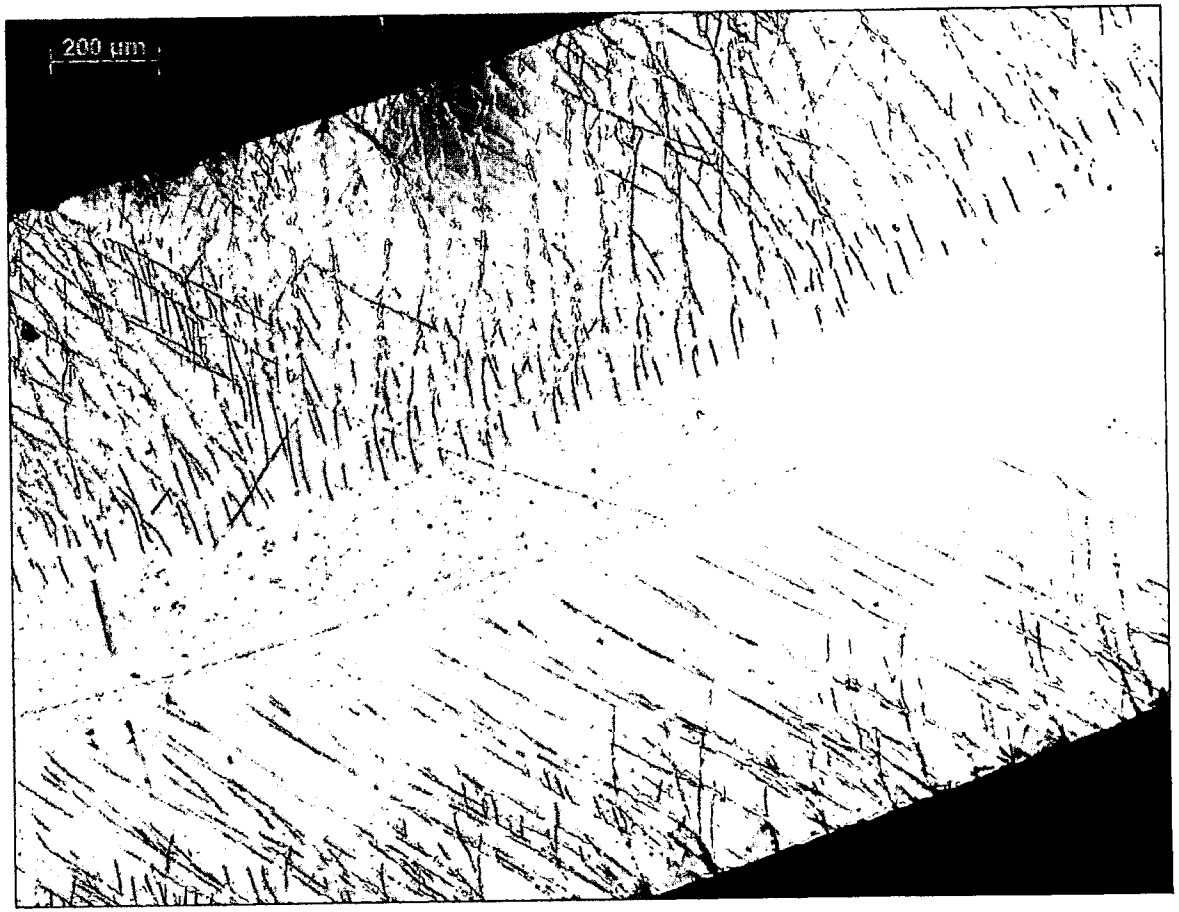
FIG. 8*c* shows an optical micrograph of a $Pt_{57.5}Cu_{14.7}Ni_{5.3}P_{22.5}$ B-SAA with dimensions of 1.8 mm×3 mm×15 mm which was bent over a mandrel of radius 6.35 mm.

FIG. 8 shows micrographs of a 1.8 mm×3 mm×15 mm sample that was bent over mandrels of radius 12.7 mm (a), 9.5 mm (b) and 6.35 mm (c). All three microstructures show multiple shear band formation with similar shear band spacings of approximately 50 μm. The plastic zone depth on both the compression and tension side of each sample is similar and increases from 700 μm (FIG. 8*a*) to 800 μm (FIG. 8*b*) to 840 μm in (FIG. 8*c*). The shear offsets in all three microstructure are around 5 μm.

Plastic deformation in metallic glasses during bending was only observed in thin samples and a direct correlation between sample thickness and plastic strain to failure was observed. The increase of plasticity with decreasing sample thickness was as a geometric effect. The authors argue that the shear displacement in a band scales with the band's length, which in turn scales with a sample's thickness. Since crack initiation scales with the shear displacement, thicker samples fail at much smaller plastic strains than thinner samples do. Plastic strains to failure similar to those measured in the present study on 4 mm thick samples were observed in Zr-based B-SA Alloys that are an order of magnitude thinner. For Zr-based B-SA Alloys thicker than 1 mm no plasticity at all was observed.

Ultrasonic measurements were carried out to determine the sound velocity in amorphous $Pt_{57.5}Cu_{14.7}Ni_{5.3}P_{22.5}$. Elastic constants were calculated from the sound velocities and are shown in Table 5. The elastic strain limit of 1.5% is calculated from the yield stress, $\sigma_y$=1400 MPa, determined from the compression test, and the Young's modulus, E=94.8 GPa, determined from speed of sound measurements. The $Pt_{57.5}Cu_{14.7}Ni_{5.3}P_{22.5}$ B-SAA exhibits an unusually low ratio of shear modulus, G, to bulk modulus, B, of 0.165. The low GB is also reflected in the high Poisson's ratio of 0.42. A small G/B ratio allows for shear collapse before the extensional instability of crack formation can occur.

TABLE 5

Results of Ultrasonic Measurements

| $v_t$ [m/s] | $v_l$ [m/s] | □ [g/cm$^3$] | G [GPa] | B [GPa] | E [GPa] | □ |
|---|---|---|---|---|---|---|
| 1481.5 | 4000 | 15.02 | 33.3 | 198.7 | 94.8 | 0.42 |

Elastic constants for amorphous $Pt_{57.5}Cu_{14.7}Ni_{5.3}P_{22.5}$, calculated from ultrasonic measurements of the transverse speed of sound, $v_t$, and the longitudinal speed of sound, $v_l$. G denotes the shear modulus, B the bulk modulus, E Young's modulus, ρ the alloy's density, and ν the Poisson's ratio.

The following alloy composition is an exemplary composition, which exhibit a Poisson's ratio of 0.38 or larger and having substantial bend ductility at room temperature.

$Pt_{57.5}Cu_{14.7}Ni_{5.3}P_{22.5}$

The following alloy composition is an exemplary composition, which exhibit a Poisson's ratio of 0.38 or larger and can be plastically deformed at room temperature after being reheated in the supercooled liquid region and plastically formed in various shapes. The processing parameters of the reheating and forming process were chosen such that if crystallization occurs it results in less than 5% by volume $Pt_{57.5}Cu_{14.7}Ni_{5.3}P_{22.5}$ Although the above discussion has focused on improved B-SA Alloys having compositions that fall within specified Poisson's ratios, and a family of exemplary Pt-based alloys, the current invention is also directed to a method for making three-dimensional bulk objects having at least a 50% (by volume) amorphous phase of these materials.

A general method of forming these alloys comprises the steps of:

a) forming an alloy of having one of the given preferred formulas in this invention; and b) cooling the entire alloy from above its melting temperature to a temperature below its glass transition temperature at a sufficient rate to prevent the formation of more than a 50% crystalline phase.

A preferred method for making three-dimensional bulk objects having at least a 50% (by volume) amorphous phase comprises the steps of:

a) forming an alloy of having one of the given preferred formulas in this invention;

b) putting the molten alloy into contact with a piece of molten de-hydrated $B_2O_3$; and then c) cooling the entire alloy, while still in contact with a piece of molten de-hydrated $B_2O_3$, from above its melting temperature to a temperature below its glass transition temperature at a sufficient rate to prevent the formation of more than a 50% crystalline phase.

Still, a more preferred method for making three-dimensional bulk objects having at least a 50% (by volume) amorphous phase comprises the steps of:

a) forming an alloy of having one of the given preferred formulas in this invention;

b) putting the molten alloy into contact with a piece of molten de-hydrated $B_2O_3$ then;

c) cooling the entire alloy to halfway its melting temperature and glass transition temperature, while still in contact with a piece of molten de-hydrated $B_2O_3$ then;

d) re-heating the entire alloy above its melting temperature, while still in contact with a piece of molten de-hydrated $B_2O_3$; and e) cooling the entire alloy, while still in contact with a piece of molten de-hydrated $B_2O_3$, from above its melting temperature to a temperature below its glass transition temperature at a sufficient rate to prevent the formation of more than a 50% crystalline phase.

A most preferred method for making three-dimensional bulk objects having at least a 50% (by volume) amorphous phase comprises the steps of:

a) forming an alloy of having one of the given preferred formulas in this invention;

b) putting the molten alloy into contact with a piece of molten de-hydrated $B_2O_3$, then;

c) cooling the entire alloy to halfway its melting temperature and glass transition temperature, while still in contact with a piece of molten de-hydrated $B_2O_3$, then;

d) re-heating the entire alloy above its melting temperature, while still in contact with a piece of molten de-hydrated $B_2O_3$;

e) repeating the steps of c) and d) multiple times; and f) cooling the entire alloy, while still in contact with a piece of molten de-hydrated $B_2O_3$, from above its melting temperature to a temperature below its glass transition temperature at a sufficient rate to prevent the formation of more than a 50% crystalline phase.

Still another method for making three-dimensional bulk objects having at least a 50% (by volume) amorphous phase comprises the steps of:

a) forming an alloy of having one of the given preferred formulas in this invention;

b) putting the molten alloy into contact with a piece of molten de-hydrated $B_2O_3$, then;

c) cooling the entire alloy to below its glass transition temperature, while still in contact with a piece of molten de-hydrated $B_2O_3$;

d) re-heating the entire alloy above its melting temperature; and e) cooling the entire alloy from above its melting temperature to a temperature below its glass transition temperature at a sufficient rate to prevent the formation of more than a 50% crystalline phase.

Still, another method for making three-dimensional bulk objects having at a least 50% (by volume) amorphous phase comprises the steps of:

a) forming an alloy of having one of the given preferred formulas in this invention;

b) putting the molten alloy into contact with a piece of molten de-hydrated $B_2O_3$, then;

c) cooling the entire alloy to halfway its melting temperature and glass transition temperature, while still in contact with a piece of molten de-hydrated $B_2O_3$;

d) re-heating the entire alloy above its melting temperature, while still in contact with a piece of molten de-hydrated $B_2O_3$;

e) repeating the steps of c) and d) multiple times;

f) cooling the entire alloy to below its glass transition temperature, while still in contact with a piece of molten de-hydrated $B_2O_3$;

g) re-heating the entire alloy above its melting temperature; and h) cooling the entire alloy from above its melting temperature to a temperature below its glass transition temperature at a sufficient rate to prevent the formation of more than a 50% crystalline phase.

A method for making high quality three-dimensional bulk objects with very little porosity having at least a 50% (by volume) amorphous phase comprising the steps of:

a) melting the material under vacuum until no floatation of bubbles can be observed;

b) cooling the entire alloy from above its melting temperature to a temperature below its glass transition temperature at a sufficient rate to prevent the formation of more than a 50% crystalline phase; and c) forming an alloy of having one of the given preferred formulas in this invention; and which has been processed according to step a and step b.

A preferred method for making high quality three-dimensional bulk objects with very little porosity having at least a 50% (by volume) amorphous phase comprises the steps of:

a) putting the molten alloy into contact with a piece of molten de-hydrated $B_2O_3$;

b) processing it under vacuum;

c) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and d) forming an alloy of having one of the given preferred formulas in this invention; and which has been processed according to step a to step c.

Still, a more preferred method for making high quality three-dimensional bulk objects which contains very little porosity having at least a 50% (by volume) amorphous phase comprises the steps of:

a) putting the molten alloy into contact with a piece of molten de-hydrated $B_2O_3$ then;

b) cooling the entire alloy to halfway its melting temperature and glass transition temperature, while still in contact with a piece of molten de-hydrated $B_2O_3$ then;

c) re-heating the entire alloy above its melting temperature, while still in contact with a piece of molten de-hydrated $B_2O_3$;

d) pulling vacuum until no observable bubble floatation can be observed;

e) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and f) forming an alloy of having one of the given preferred formulas in this invention, and which has been processed according to step a to step e.

A most preferred method for making high quality three-dimensional bulk objects containing very little amount of gas entrapment and having at least a 50% (by volume) amorphous phase comprises the steps of:

a) putting the molten alloy into contact with a piece of molten de-hydrated $B_2O_3$, then;

b) cooling the entire alloy to halfway its melting temperature and glass transition temperature, while still in contact with a piece of molten de-hydrated $B_2O_3$, then;

c) re-heating the entire alloy above its melting temperature, while still in contact with a piece of molten de-hydrated $B_2O_3$;

d) repeating the steps of b) and c) multiple times;

e) pulling vacuum until no observable bubble floatation can be observed;

f) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and g) forming an alloy of having one of the given preferred formulas in this invention, which has been processed according to step a to step f.

Still another method for making high quality three-dimensional bulk objects that contains very little entrapped gas having at least a 50% (by volume) amorphous phase comprises the steps of:

a) putting the molten alloy into contact with a piece of molten de-hydrated $B_2O_3$, then;

b) cooling the entire alloy to below its glass transition temperature, while still in contact with a piece of molten de-hydrated $B_2O_3$;

c) re-heating the entire alloy above its melting temperature;

d) pulling vacuum until no observable bubble floatation can be observed;

e) cooling the entire alloy from above its melting temperature to a temperature below its glass transition temperature at a sufficient rate to prevent the formation of more than a 50% crystalline phase; and f) forming an alloy of having one of the given preferred formulas in this invention; which has been processed by step a to step e.

Still, another method for making high quality three-dimensional bulk objects which contains very little entrapped gas having at a least 50% (by volume) amorphous phase comprises the steps of:

a) putting the molten alloy into contact with a piece of molten de-hydrated $B_2O_3$, then;

b) cooling the entire alloy to halfway its melting temperature and glass transition temperature, while still in contact with a piece of molten de-hydrated $B_2O_3$;

c) re-heating the entire alloy above its melting temperature, while still in contact with a piece of molten de-hydrated $B_2O_3$;

d) repeating the steps of b) and c) multiple times;

e) cooling the entire alloy to below its glass transition temperature, while still in contact with a piece of molten de-hydrated $B_2O_3$;

f) re-heating the entire alloy above its melting temperature;

g) processing under vacuum until no observable bubble floatation can be observed;

h) cooling the entire alloy from above its melting temperature to a temperature below its glass transition temperature at a sufficient rate to prevent the formation of more than a 50% crystalline phase; and i) forming an alloy of having one of the given preferred formulas in this invention; which has been processed by step a to step h.

A method for making high quality three-dimensional bulk objects with very little porosity having at least a 50% (by volume) amorphous phase comprising the steps of:

a) melting the material under vacuum until no floatation of bubbles can be observed;

b) increasing the pressure to 5-150 psi;

c) cooling the entire alloy from above its melting temperature to a temperature below its glass transition temperature at a sufficient rate to prevent the formation of more than a 50% crystalline phase; and d) forming an alloy of having one of the given preferred formulas in this invention, and which has been processed according to step a and step c.

A preferred method for making high quality three-dimensional bulk objects with very little porosity having at least a 50% (by volume) amorphous phase comprises the steps of:

a) putting the molten alloy into contact with a piece of molten de-hydrated $B_2O_3$; then b) processing it under vacuum;

c) increasing the pressure to 5-150 psi;

d) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and e) forming an alloy of having one of the given preferred formulas in this invention, and which has been processed according to step a to step d.

Still, a more preferred method for making high quality three-dimensional bulk objects which contains very little porosity having at least a 50% (by volume) amorphous phase comprises the steps of:

a) putting the molten alloy into contact with a piece of molten de-hydrated $B_2O_3$ then;

b) cooling the entire alloy to halfway its melting temperature and glass transition temperature, while still in contact with a piece of molten de-hydrated $B_2O_3$ then;

c) re-heating the entire alloy above its melting temperature, while still in contact with a piece of molten de-hydrated $B_2O_3$;

d) pulling vacuum until no observable bubble floatation can be observed;

e) increasing the pressure to 5-150 psi;

f) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and g) forming an alloy of having one of the given preferred formulas in this invention, which has been processed according to step a to step f.

A most preferred method for making high quality three-dimensional bulk objects containing very little amount of gas entrapment and having at least a 50% (by volume) amorphous phase comprises the steps of:

a) putting the molten alloy into contact with a piece of molten de-hydrated $B_2O_3$, then;

b) cooling the entire alloy to halfway its melting temperature and glass transition temperature, while still in contact with a piece of molten de-hydrated $B_2O_3$, then;

c) re-heating the entire alloy above its melting temperature, while still in contact with a piece of molten de-hydrated $B_2O_3$;

d) repeating the steps of b) and c) multiple times;

e) pulling vacuum until no observable bubble floatation can be observed;

f) increasing the pressure to 5-150 psi;

g) cooling the entire alloy, while still in contact with a piece of molten de-hydrated $B_2O_3$, from above its melting temperature to a temperature below its glass transition temperature at a sufficient rate to prevent the formation of more than a 50% crystalline phase; and h) forming an alloy of having one of the given preferred formulas in this invention, which has been processed according to step a to step g.

Still another method for making high quality three-dimensional bulk objects that contains very little entrapped gas having at least a 50% (by volume) amorphous phase comprises the steps of:

a) putting the molten alloy into contact with a piece of molten de-hydrated $B_2O_3$, then;

b) cooling the entire alloy to below its glass transition temperature, while still in contact with a piece of molten de-hydrated $B_2O_3$;

c) re-heating the entire alloy above its melting temperature;

d) pulling vacuum until no observable bubble floatation can be observed;

e) increasing the pressure to 5-150 psi;

f) cooling the entire alloy from above its melting temperature to a temperature below its glass transition temperature at a sufficient rate to prevent the formation of more than a 50% crystalline phase; and g) forming an alloy of having one of the given preferred formulas in this invention, which has been processed by step a to step f.

Still, another method for making high quality three-dimensional bulk objects which contains very little entrapped gas having at a least 50% (by volume) amorphous phase comprises the steps of:

a) putting the molten alloy into contact with a piece of molten de-hydrated $B_2O_3$, then;

b) cooling the entire alloy to halfway its melting temperature and glass transition temperature, while still in contact with a piece of molten de-hydrated $B_2O_3$;

c) re-heating the entire alloy above its melting temperature, while still in contact with a piece of molten de-hydrated $B_2O_3$;

d) repeating the steps of b) and c) multiple times;

e) cooling the entire alloy to below its glass transition temperature, while still in contact with a piece of molten de-hydrated $B_2O_3$;

f) re-heating the entire alloy above its melting temperature;

g) processing under vacuum until no observable bubble floatation can be observed;

h) increasing the pressure to 5-150 psi;

i) cooling the entire alloy from above its melting temperature to a temperature below its glass transition temperature at a sufficient rate to prevent the formation of more than a 50% crystalline phase; and j) forming an alloy of having one of the given preferred formulas in this invention, which has been processed by step a to step i.

Although the above methods are generally suitable for processing the alloys of the current invention, one unique property of bulk solidifying alloys is that they can be formed in the supercooled liquid region, the temperature region between the glass transition temperature Tg and the crystallization temperature, where the amorphous phase first relaxes into a high viscous liquid before it eventually crystallizes. Some bulk solidifying amorphous alloys however lose their fracture toughness during that process quite readily and are no longer useful structural materials. Accordingly, in one embodiment of the current invention the bulk solidifying amorphous alloy has a Poisson's ratio of 0.38 or larger in its as-cast state, and its Poisson's ratio is preserved during reprocessing in the supercooled liquid region around or above 0.38. In this embodiment it should be understood that the processing parameters described above have to be chosen such that crystallization during this process is less than 5%. Lower temperatures and shorter times will improve the preservation of high Poisson's ratio during reprocessing. The above experimental data can be used as a guideline as well as the time and temperature guidelines as disclosed in U.S. Pat. No. 6,875,293, the disclosure of which is incorporated herein by reference.

The cooling of the bulk solidifying amorphous alloy may also influence its properties. For example, even if the material is cooled faster than the critical cooling rate properties such as density, Tg, and viscosity are influenced. Fast cooling also increases the Poisson's ratio. Accordingly, in another embodiment of the current invention the bulk solidifying amorphous alloy is cooled substantially faster than the critical cooling rate and the resulting Poisson's ratio is 0.38 or larger.

The preceding description has been presented with references to presently preferred embodiments of the invention. Persons skilled in the art and technology to which this invention pertains will appreciate that alterations and changes in the described compositions and methods of manufacture can be practiced without meaningfully departing from the principle, spirit and scope of this invention. Accordingly, the foregoing description should not be read as pertaining only to the precise compositions described and shown in the accompanying drawings, but rather should be read as consistent with and as support for the following claims, which are to have their fullest and fairest scope.

What is claimed is:

1. A method of forming a three-dimensional object having minimum dimensions of at least 0.5 mm in all dimensions and at least 50% amorphous phase by volume throughout the three-dimensional object from an alloy comprising a bulk-solidifying amorphous alloy, the method comprising:

providing a molten volume of the alloy;

quenching the entire volume of the alloy from above its melting temperature to a temperature below its glass transition temperature to form an as-cast object, wherein the quenching occurs at a sufficient rate to prevent formation of more than about 50% crystalline phase by volume;

reheating the as-cast object having no more than about 50% crystalline phase by volume in a supercooled region after quenching to form a reheated alloy, and re-quenching the alloy from the supercooled region to a temperature below its glass transition temperature at a sufficient rate to prevent formation of more than about 50% crystalline phase by volume;

wherein during or after the reheating the as-cast object is put under vacuum until no bubble flotation is present.

2. The method of claim 1, wherein the Poisson's ratio for the as-cast object and the reheated alloy does not differ by more than 5%.

3. The method of claim 2, wherein the Poisson's ratio of the reheated alloy is at least 0.38.

4. The method of claim 1, wherein the step of quenching or re-quenching comprises cooling the bulk solidifying amorphous alloy at a rate substantially faster than the critical cooling rate of the alloy.

5. The method of claim 1, further comprising:

providing two or more pieces of the bulk-solidifying amorphous alloy; and bonding said pieces together by applying pressure that results in the physical contact of the pieces during the reheating step.

6. The method of claim 1, wherein the three-dimensional object has minimum dimensions of at least 1.0 mm in all dimensions.

7. The method of claim 1, wherein a near net shape object is formed at a temperature between the glass transition temperature and the crystallization temperature of the alloy.

8. The method of claim 1, further comprising:

providing a quantity of feedstock materials for the alloy; and melting the feedstock under vacuum to form the molten alloy such that no flotation of bubbles is present.

9. The method of claim 8, wherein after inciting under vacuum the pressure is increased from about 5 psi to about 150 psi.

10. The method of claim 1, wherein the molten alloy is processed under vacuum.

11. The method of claim 1, wherein the bulk-solidifying amorphous alloy is $Pt_{57.5}Cu_{14.7}Ni_{5.3}P_{22.5}$ and the alloy is reheated in the supercooled liquid region for a time and temperature such that the crystalline phase of the alloy by volume is less than 3%, and the fracture toughness after this process is more than 60 MPa $m^{1/2}$.

12. The method of claim 1, wherein the alloy comprises a Pt-based bulk-solidifying amorphous alloy according to a formula: $(Pt,Pd)_{1-x}PGM_x)_a((Cu,Co,Ni)_{1-y}TM_y)_b(P,Si)_{1-z}OM_z)_c$, where a is from about 35 to 50 atomic percent, b is from about 30 to 45 atomic percent, c is from about 18 to 20 atomic percent, wherein Pt and P are each at least about 10 atomic percent of the whole, and where the total of Ni and Co content is at least about 2 atomic percentage; where PGM is selected from the group consisting of Ir, Os, Au, W, Ru, Rh, Ta, Nb, and Mo; where TM is selected from the group consisting of Fe, Zn, Ag, Mn, and V; where OM is selected from the group consisting of B, Al, Ga, Ge, Sn, Sb, and As; and where the x, y, and z fraction follow the following constraints: z is less than about 0.3, the sum of x, y, and z is less than about 0.5, x is from about 0 to 0.1 and y is less than about 0.2.

13. A method of forming a three-dimensional object having minimum dimensions of at least 0.5 mm in all dimensions and at least 50% amorphous phase by volume from an alloy comprising a bulk-solidifying amorphous alloy, the method comprising:

providing a molten volume of the alloy; and quenching the entire volume of the alloy from above its melting temperature to a temperature below its glass transition temperature to form an as-cast object, wherein the quenching occurs at a sufficient rate to prevent formation of more than about 50% crystalline phase by volume, wherein the alloy comprises a Pt-based bulk-solidifying amorphous alloy according to a formula $Pt_aCo_bCu_cNi_dP_e$, wherein a is from about 39 to about 50 atomic percentage, b is from about 0 to 15 atomic percent, c is from about 12 to about 35 atomic percentage, d is from 0 to 15 atomic percent, and e is from about 17 to about 29 atomic percent, wherein the sum of b and d is greater than 2 atomic percent, and wherein Pt comprises at least 75 percent of the Pt-based alloy by weight.

14. A method of forming a three-dimensional object having minimum dimensions of at least 0.5 mm in all dimensions and at least 50% amorphous phase by volume from an alloy comprising a bulk-solidifying amorphous alloy, the method comprising:

providing a molten volume of the alloy; and quenching the entire volume of the alloy from above its melting temperature to a temperature below its glass transition temperature to form an as-cast object, wherein the quenching occurs at a sufficient rate to prevent formation of more than about 50% crystalline phase by volume, wherein the alloy comprises a Pt-based hulk-solidifying amorphous alloy according to a formula $Pt_aCo_bCu_cNi_dP_e$, wherein a is from about 54 to about 64 atomic percentage, b is from about 0 to 8 atomic percent, c is from about 9 to about 20 atomic percentage, d is from 0 to 12 atomic percent, and e is from about 17 to about 24 atomic percent, wherein the sum of b and d is greater than 2 atomic percent, and wherein Pt comprises at least 85 percent of the Pt-based alloy by weight.

15. A method of forming a three-dimensional object having minimum dimensions of at least 0.5 mm in all dimensions and at least 50% amorphous phase by volume from an alloy comprising a bulk-solidifying amorphous alloy, the method comprising:

providing a molten volume of the alloy; and quenching the entire volume of the alloy from above its melting temperature to a temperature below its glass transition temperature to form an as-cast object, wherein the quenching occurs at a sufficient rate to prevent formation of more than about 50% crystalline phase by volume, wherein the alloy comprises a Pt-based bulk-solidifying amorphous alloy according to a formula $(Pt,Pd)_aCo_bCu_cNi_dP_e$, wherein a is from about 20 to about 65 atomic percentage, b is from about 0 to 8 atomic percent, c is from about 9 to about 20 atomic percentage, d is from 0 to 12 atomic percent, and e is from about 17 to about 24 atomic percent, wherein the sum of b and d is greater than 2 atomic percent; wherein Pt comprises at least 85 percent of the Pt-based bulk-solidifying alloy by weight, wherein the total content of Pd and Pt in the alloy is less than about 40 atomic percent the ratio of Pd to Pt is up to 4, wherein the total content of Pd and Pt is between about 40 to about 50 atomic percent the ratio of Pd to Pt is up to 6, or wherein the total content of Pd and Pt is greater than 50 atomic percent the ratio of Pd to Pt is up to 8.

16. A method of forming a three-dimensional object having minimum dimensions of at least 0.5 mm in all dimensions and at least 50% amorphous phase by volume from an alloy comprising a bulk-solidifying amorphous alloy, the method comprising:

providing a molten volume of the alloy; and quenching the entire volume of the alloy from above its melting temperature to a temperature below its glass transition temperature to form an as-cast object, wherein the quenching occurs at a sufficient rate to prevent formation of more than about 50% crystalline phase by volume, wherein the alloy comprises a Pt-based bulk-solidifying amorphous alloy according to a formula: $(Pt_{1-x}Pd_x)_a(Cu_{1-y}(Co,Ni)_y)_b(P_{1-z}Si_z)_c$, where a is in the range of about 35 to 50 atomic percent, b is in the range of about 30 to 45 atomic percent, c is in the range of about 18 to 20 atomic percent, x is in the range of about 0 to 0.8, y is in the range of about 0.05 to 1, and z is in the range of about 0 to 0.4.

17. A method of forming a three-dimensional object having minimum dimensions of at least 0.5 mm in all dimensions and at least 50% amorphous phase by volume from an alloy comprising a bulk-solidifying amorphous alloy, the method comprising:

providing a molten volume of the alloy; and quenching the entire volume of the alloy from above its melting temperature to a temperature below its glass transition temperature to form an as-cast object, wherein the quenching occurs at a sufficient rate to prevent formation of more than about 50% crystalline phase by volume, wherein the alloy comprises a Pt-based bulk solidifying amorphous alloy according to a formula: $Pt_a(Cu_{1-y}Ni_y)_bP_c$, where a is in the range of about 35 to 50 atomic percent, b is in the range of about 30 to 45 atomic percent, c is in the range of about 18 to 20 atomic percent and y is in the range of about 0.05 to 1.

18. A method of forming a three-dimensional object having minimum dimensions of at least 0.5 mm in all dimensions and at least 50% amorphous phase by volume from an alloy comprising a bulk-solidifying amorphous alloy, the method comprising:

providing a molten volume of the alloy; and quenching the entire volume of the alloy from above its melting temperature to a temperature below its glass transition temperature to form an as-cast object, wherein the quenching occurs at a sufficient rate to prevent formation of more than about 50% crystalline phase by volume, wherein the bulk-solidifying amorphous alloy has a following composition: $(Pt,Pd)_xM_yP_z$ wherein M is a combination of at least Cu and Ni, having a ratio of Cu to Ni of from about 1 to 4, x is from about 20 to 60 atomic percent, y is from 15 to 60 atomic percent and z is from about 16 to 24 atomic percent, and wherein Pd is optionally included in the alloy; wherein the combination of components has a Poisson's ratio of at least 0.38; the alloy exhibiting an elastic strain limit of at least about 1.5%, a ductility of more than about 10% under compression geometries with aspect ratio more than about 2, a bend ductility of more than about 3% under bending geometries with a thickness more than about 2.0 mm, and a fracture toughness greater than about 35 MPa $m^{1/2}$.

19. A method of forming a three-dimensional object having minimum dimensions of at least 0.5 mm in all dimensions and at least 50% amorphous phase by volume from an alloy comprising a bulk-solidifying amorphous alloy, the method comprising:

providing a molten volume of the alloy; and quenching the entire volume of the alloy from above its melting temperature to a temperature below its glass transition temperature to form an as-cast object, wherein the quenching occurs at a sufficient rate to prevent formation of more than about 50% crystalline phase by volume, wherein the alloy comprises a Pt-based bulk-solidifying amorphous alloy according to a formula $(Pt, Pd)_{1-x}PGM_x)_a((Cu,Co,Ni)_{1-y}TM_y)_b(P,Si)_{1-z}OM_x)_c$, wherein a is from about 20 to 65 atomic percent, b is from about 15 to 60 atomic percent, c is from about 16 to 24 atomic percent; wherein the concentration of Pt is at least about 10 atomic percent; wherein Co is non-zero concentration and the total combine concentration of Ni and Co is at least about 2 atomic percent; wherein the concentration of P is at least 10 atomic percent; wherein PGM is selected from the group consisting of Ir, Os, Au, W, Ru, Rh, Ta, Nb, and Mo; wherein TM is selected from the group consisting of Fe, Zn, Ag, Mn, and V; wherein OM is selected from the group consisting of B, Al, Ga, Ge, Sn, Sb, and As; and wherein the x, y, and z are atomic fractions having the following constraints: z is less than about 0.3, the sum of x, y, and z is less than about 0.5; and when a is less than 35, x is less than about 0.3 and y is less than about 0.1; when a is in the range of from about 35 to 50, x is less than about 0.2 and y is less than about 0.2; and when a is more than 50, x is less than about 0.1 and y is less than about 0.3; and wherein the combination of components has a Poisson's ratio of at least about 0.38.

20. A method of forming a three-dimensional object having minimum dimensions of at least 0.5 mm in all dimensions and at least 50% amorphous phase by volume from an alloy comprising a bulk-solidifying amorphous alloy, the method comprising:

providing a molten volume of the alloy; and quenching the entire volume of the alloy from above its melting temperature to a temperature below its glass transition temperature to form an as-cast object, wherein the quenching occurs at a sufficient rate to prevent formation of more than about 50% crystalline phase by volume, wherein the bulk-solidifying amorphous alloy comprises a plurality of elemental components, wherein the bulk-solidifying amorphous alloy has a size of a notch tip plastic zone that is larger than that of a Zr-based bulk-solidifying amorphous alloy, a yield strength of at least about 1400 MPa, a Vickers Hardness of at least about 358, a critical casting thickness of at least about 2 mm, an elastic strain limit of at least about 1.5%, a liquidus temperature below about 1273 K, a ratio of a glass transition temperature to the liquidus temperature of less than about 0.6, and a fracture toughness ($K_{1c}$) greater than about 60 MPa $m^{1/2}$.

21. A method of forming a three-dimensional object having minimum dimensions of at least 0.5 mm in all dimensions and at least 50% amorphous phase by volume from an alloy comprising a bulk-solidifying amorphous alloy, the method comprising:

providing a molten volume of the alloy; and quenching the entire volume of the alloy from above its melting temperature to a temperature below its glass transition temperature to form an as-cast object, wherein the quenching occurs at a sufficient rate to prevent formation of more than about 50% crystalline phase by volume, wherein the bulk-solidifying amorphous alloy comprises a plurality of elemental components, wherein the bulk-solidifying amorphous alloy has a critical crack radius that is substantially larger than a critical crack radius in a Zr-based bulk solidifying amorphous alloy, a yield strength of at least about 1400 MPa, a Vickers Hardness of at least about 358, a critical casting thickness of at least about 2 mm, an elastic strain limit of at least about 1.5%, a liquidus temperature below about 1273 K, a ratio of a glass transition temperature to the liquidus temperature of less than about 0.6, and a fracture toughness ($K_{1c}$) greater than about 60 MPa $m^{1/2}$.

22. A method of forming a three-dimensional object having minimum dimensions of at least 0.5 mm in all dimensions and at least 50% amorphous phase by volume from an alloy comprising a bulk-solidifying amorphous alloy, the method comprising:

providing a molten volume of the alloy; and quenching the entire volume of the alloy from above its melting temperature to a temperature below its glass transition temperature to form an as-cast object, wherein the quenching occurs at a sufficient rate to prevent formation of more than about 50% crystalline phase by volume, wherein the bulk-solidifying amorphous alloy comprises a plurality elemental components, wherein the bulk-solidifying amorphous alloy has a size of a notch tip plastic zone that is larger than that of a Zr-based bulk-solidifying amorphous alloy, a yield strength of at least about 1400 MPa, a Vickers Hardness of at least about 358, a critical casting thickness of at least about 2 mm, an elastic strain limit of at least about 1.5%, a liquidus temperature below about 1273 K, a glass transition temperature less than about 251 degree C., and a fracture toughness ($K_{1c}$) greater than about 60 MPa $m^{1/2}$.

* * * * *